US009143868B2

(12) United States Patent
Pinkerton et al.

(10) Patent No.: US 9,143,868 B2
(45) **Date of Patent: *Sep. 22, 2015**

(54) ELECTRICALLY CONDUCTIVE MEMBRANE PUMP/TRANSDUCER AND METHODS TO MAKE AND USE SAME

(71) Applicant: CLEAN ENERGY LABS, LLC, Austin, TX (US)

(72) Inventors: Joseph F. Pinkerton, Austin, TX (US); David A. Badger, Austin, TX (US)

(73) Assignee: Clean Energy Labs, LLC, Austin, TX (US)

( * ) Notice: Subject to any disclaimer, the term of this patent is extended or adjusted under 35 U.S.C. 154(b) by 32 days.

This patent is subject to a terminal disclaimer.

(21) Appl. No.: 14/047,813

(22) Filed: Oct. 7, 2013

(65) Prior Publication Data

US 2014/0037126 A1 Feb. 6, 2014

Related U.S. Application Data

(63) Continuation-in-part of application No. PCT/US2012/058247, filed on Oct. 1, 2012.

(60) Provisional application No. 61/541,779, filed on Sep. 30, 2011.

(51) Int. Cl.

| | |
|---|---|
| ***H04R 25/00*** | (2006.01) |
| ***H04R 19/02*** | (2006.01) |
| ***H04R 7/02*** | (2006.01) |
| ***F04B 43/04*** | (2006.01) |
| ***H04R 23/00*** | (2006.01) |

(52) U.S. Cl.
CPC ..... *H04R 19/02* (2013.01); *F04B 43/043* (2013.01); *H04R 7/02* (2013.01); *H04R 23/00* (2013.01)

(58) Field of Classification Search
USPC ..... 381/328, 380, 150, 191
See application file for complete search history.

(56) References Cited

U.S. PATENT DOCUMENTS

| | | | | |
|---|---|---|---|---|
| 7,995,777 | B2 * | 8/2011 | Yu et al. | 381/191 |
| 8,526,652 | B2 * | 9/2013 | Ambrose et al. | 381/328 |
| 2004/0047477 | A1 * | 3/2004 | Bank et al. | 381/120 |
| 2009/0052699 | A1 * | 2/2009 | Andersen | 381/173 |
| 2009/0166067 | A1 * | 7/2009 | Iwai et al. | 174/257 |
| 2012/0308415 | A1 | 12/2012 | Pinkerton | |

FOREIGN PATENT DOCUMENTS

| | | | |
|---|---|---|---|
| JP | 2003-319491 | A | 11/2003 |
| WO | 2011097390 | A1 | 8/2011 |
| WO | 2013049794 | A1 | 4/2013 |

OTHER PUBLICATIONS

European Patent Office, Patent Abstracts of Japan for Japanese Patent Application No. 2003-319491; Nov. 7, 2003; 1 page; Europe.

Shahosseini et al.; "Towards High Fidelity High Efficiency MEMS Microspeakers," Sensors, 2010, pp. 2426-2430, IEEE, Piscataway, NJ.

(Continued)

*Primary Examiner* — Davetta W Goins
*Assistant Examiner* — Amir Etesam
(74) *Attorney, Agent, or Firm* — Greenberg Traurig, LLP; Ross Spencer Garsson

(57) ABSTRACT

An improved electrically conductive membrane pump/transducer, such as a graphene membrane transducer.

20 Claims, 36 Drawing Sheets

(56) References Cited

OTHER PUBLICATIONS

Patent Cooperation Treaty, PCT International Search Report, Issued in Connection with PCT/US2012/058247; Jan. 14, 2013; 3 pages; Europe.

Patent Cooperation Treaty, PCT Written Opinion of the International Searching Authority, Issued in Connection with PCT/US2012/058247; Jan. 14, 2013; 7 pages; Europe.

* cited by examiner

ELECTRICALLY CONDUCTIVE MEMBRANE PUMP/TRANSDUCER AND METHODS TO MAKE AND USE SAME

CROSS-REFERENCE TO RELATED PATENT APPLICATIONS

This application is a continuation-in-part of International Patent Application No. PCT/2012/058247, filed Oct. 1, 2012, which designated the United States and claimed priority to provisional U.S. Patent Application Ser. No. 61/541,779, filed on Sep. 30, 2011. Each of these patent applications is entitled "Electrically Conductive Membrane Transducer And Methods To Make And Use Same." All of these above-identified patent applications are commonly assigned to the Assignee of the present invention and are hereby incorporated herein by reference in their entirety for all purposes.

TECHNICAL FIELD

The present invention relates to an electrically conductive membrane pump/transducer. The electrically conductive membrane can be, for example, a graphene membrane.

BACKGROUND

Conventional audio speakers compress/heat and rarify/cool air (thus creating sound waves) using mechanical motion of a cone-shaped membrane at the same frequency as the audio frequency. Most cone speakers convert less than 10% of their electrical input energy into audio energy. These speakers are also bulky in part because large enclosures are used to muffle the sound radiating from the backside of the cone (which is out of phase with the front-facing audio waves). Cone speakers also depend on mechanical resonance; a large "woofer" speaker does not efficiently produce high frequency sounds, and a small "tweeter" speaker does not efficiently produce low frequency sounds.

Thermoacoustic (TA) speakers use heating elements to periodically heat air to produce sound waves. TA speakers do not need large enclosures or depend on mechanical resonance like cone speakers. However, TA speakers are terribly inefficient, converting well under 1% of their electrical input into audio waves.

The present invention relates to an improved transducer (i.e., speaker) that includes an electrically conductive membrane such as, for example, a graphene membrane. In some embodiments, the transducer can be an ultrasonic transducer. An ultrasonic transducer is a device that converts energy into ultrasound (sound waves above the normal range of human hearing). Examples of ultrasound transducers include a piezoelectric transducers that convert electrical energy into sound. Piezoelectric crystals have the property of changing size when a voltage is applied, thus applying an alternating current (AC) across them causes them to oscillate at very high frequencies, thereby producing very high frequency sound waves.

The location at which a transducer focuses the sound can be determined by the active transducer area and shape, the ultrasound frequency, and the sound velocity of the propagation medium. The medium upon which the sound waves are carries can be any gas or liquid (such as air or water, respectively).

Graphene membranes (also otherwise referred to as "graphene drums") have been manufactured using a process such as disclosed in Lee et al. Science, 2008, 321, 385-388. PCT Patent Appl. No. PCT/US09/59266 (Pinkerton) (the "PCT US09/59266 Application") described tunneling current switch assemblies having graphene drums (with graphene drums generally having a diameter between about 500 nm and about 1500 nm). PCT Patent Appl. No. PCT/US11/55167 (Pinkerton et al.) and PCT Patent Appl. No. PCT/US11/66497 (Everett et al.) further describe switch assemblies having graphene drums. PCT Patent Appl. No. PCT/US11/23618 (Pinkerton) (the "PCT US11/23618 Application") described a graphene-drum pump and engine system.

In embodiments of such graphene-drum pump and engine systems the graphene drum could be between about 500 nm and about 1500 nm in diameter (i.e., around one micron in diameter), such that millions of graphene-drum pumps could fit on one square centimeter of a graphene-drum pump system or graphene-drum engine system. In other embodiments, the graphene drum could be between about 10 μm to about 20 μm in diameter and have a maximum deflection between about 1 μm to about 3 μm (i.e., a maximum deflection that is about 10% of the diameter of the graphene drum). As used herein, "deflection" of the graphene drum is measured relative to the non-deflected graphene drum (i.e., the deflection of a non-deflected graphene drum is zero).

FIG. 1 depicts a perspective view of the graphene-drum pump system illustrated in the PCT US11/23618 Application (described in paragraphs [00102]-[00113] and in FIGS. 1-3, therein). FIGS. 2-3 depict close-ups of the graphene-drum pump (in the graphene-drum pump system of FIG. 1) in exhaust mode and intake mode, respectively.

As illustrated in FIGS. 1-3 (which are similar to FIGS. 1-3 of the PCT US11/23618 Application), the top layer 102 is graphene. The top layer is mounted on an insulating material 103 (such as silicon dioxide). Graphene-drum pump 101 utilizes a graphene drum as the main diaphragm (main diaphragm graphene drum 201). The main diaphragm seals a boundary of the cavity 202 of the graphene-drum pump 101. The cavity is also bounded by insulating material 103 and a metallic gate 203 (which is a metal such as tungsten). The metallic gate 203 is operatively connected to a voltage source (not shown), such as by a metallic trace 204. The main diaphragm graphene drum 201 can be designed to operate in a manner similar to the graphene drums taught and described in the PCT US09/59266 Application and PCT US11/23618 Application.

The graphene-drum pump also includes an upstream valve 205 and a downstream valve 206. As illustrated in FIG. 2, upstream valve 205 includes another graphene drum (the upstream valve graphene drum 207). The upstream valve 205 is connected (a) to a fluid source (not shown) by a conduit 208 and (b) to the cavity 202 by conduit 209, which conduits 208 and 209 are operable to allow fluid (such as a gas or a liquid) to flow from the fluid source through the upstream valve 205 and into the cavity 202. The upstream valve 205 also has a cavity 210 bounded (and sealed) by the upstream valve graphene drum 207, the insulating material 103, and upstream valve gate 211. The upstream valve graphene drum 207 can be designed to operate in a manner similar to the graphene drums taught and described in the PCT US09/59266 Application and PCT US11/23618 Application. For instance, the upstream valve 205 can be closed or opened by varying the voltage between upstream valve graphene drum 207 and upstream valve gate 211. When the upstream valve 205 is closed, van der Waals forces will maintain the upstream valve graphene drum 207 in the seated position, which will keep the upstream valve 205 in the closed position.

As illustrated in FIG. 2, the downstream valve 206 includes another graphene drum (the downstream valve graphene drum 212). The downstream valve 206 is connected (a) to the cavity 202 by a conduit 213 and (b) to a fluid output (not shown) by conduit 214, which conduits 213 and 214 are operable to allow fluid to flow from the cavity 202 through the downstream valve 205 and into the fluid output. The downstream valve 206 also has a cavity 215 bounded (and sealed) by the downstream valve graphene drum 212, the insulating material 103, and downstream valve gate 216. The downstream valve graphene drum 212 can be designed to operate in a manner similar to the graphene drums taught and described in the PCT US09/59266 Application and PCT US11/23618 Application. For instance, the downstream valve 206 can be closed or opened by varying the voltage between downstream valve graphene drum 212 and downstream valve gate 216. When the downstream valve 206 is closed, van der Waals forces will maintain the downstream valve graphene drum 212 in the seated position, which will keep the downstream valve 206 in the closed position. Generally, upstream valve gate 211 and downstream valve gate 216 are synchronized so that when the upstream valve 205 is opened, downstream valve is closed (and vice versa).

FIG. 2 depicts the graphene-drum pump 101 in exhaust mode. In the exhaust mode, the upstream valve 205 is closed and the downstream valve 206 is opened, while the main diaphragm graphene drum 201 is being pulled downward (such as due to a voltage between the main diaphragm graphene drum 201 and metallic gate 203). This results in the fluid (such as air) being pumped from the cavity 202 through the downstream valve 205 and into the fluid output.

FIG. 3 depicts graphene-drum pump 101 in intake mode. In the intake mode, the upstream valve 205 is opened and the downstream valve 206 is closed, while the main diaphragm graphene drum 201 moves upward. (For instance, by reducing the voltage between the main diaphragm graphene drum 201 and metallic gate 203, the graphene drum 201 will spring upward beyond its "relaxed" position). This results in the fluid (such as air) being drawn from the fluid source through the upstream valve 205 and into the cavity 202.

To reduce or avoid wear of the upstream valve 205 that utilizes an upstream valve graphene drum 207, embodiments of the invention can include an upstream valve element 217 to sense the position between the upstream valve graphene drum 207 and bottom of cavity 210. Likewise to reduce or avoid wear of the downstream valve 206 that utilizes a downstream valve graphene drum 212, embodiments of the invention can include an downstream valve element 218 to sense the position between the downstream valve graphene drum 212 and bottom of cavity 215. The reason for this is because of the wear that upstream valve 205 and downstream valve 206 will incur during cyclic operation, which can be on the order of 100 trillion cycles during the device lifetime. Because of such wear, upstream valve graphene drum 207 and downstream valve graphene drum 212 cannot repeatedly hit down upon the channel openings to conduit 209 and conduit 213, respectively.

As shown in FIG. 2, upstream valve element 217 is shown in the center/bottom of cavity 210 of the upper valve 205, and downstream valve element 218 is shown in the center/bottom of cavity 215 of downstream valve 206. Upstream valve element 217 is used to sense the position of the upstream valve graphene drum 207 relative to the bottom of cavity 210 by using extremely sensitive tunneling currents as feedback. A separate circuit (not shown) is connected between the upstream valve element 217 and the upstream valve graphene drum 207. Likewise downstream valve element 218 is used to sense the position of the downstream valve graphene drum 207 relative to the bottom of cavity 215 by using extremely sensitive tunneling currents as feedback. A separate circuit (not shown) is connected between the upstream valve element 218 and the upstream valve graphene drum 212.

With respect to the upstream valve 205, when the upstream valve graphene drum 207 is within about 1 nm of the upstream valve element 217, a significant tunneling current will flow between the upstream valve graphene drum 205 and the upstream valve element 217. This current can be used as feedback to control the voltage of upstream valve gate 211. When this current is too high, the gate voltage of upstream valve gate 211 will be decreased. And, when this current is too low, the gate voltage of upstream valve gate 211 will be increased (so that the valve stays in its "closed" position, as shown in FIG. 2, until it is instructed to open). There will likely be a gap (around 0.5 nm) between the upstream valve graphene drum 207 and channel opening to conduit 209 when the upstream valve 205 is closed; this gap is so small that it prevents most fluid molecules from passing through the upstream valve 205 yet the gap is large enough to avoid wear. For instance, in an embodiment of the invention, a resistor and voltage source (not shown) can be utilized. The resistor can be placed between the upstream valve element 217 and the voltage source. When the upstream valve graphene drum 207 comes within tunneling current distance (such as around 0.3 to 1 nanometers) of upstream valve element 217, the tunneling current will flow through upstream valve graphene drum 207, upstream valve element 217 and the resistor. This tunneling current in combination with the resistor will lower the voltage between upstream valve element 217 and upstream valve graphene drum 207, thus lowering the electrostatic force between upstream valve element 217 and upstream valve graphene drum 207. If upstream valve graphene drum upstream valve graphene drum moves away from upstream valve graphene 217, the tunneling current will drop and the voltage/force between upstream valve graphene drum 207 and upstream valve element 217 will increase. Thus a 0.3 to 1 nanometer gap between upstream valve graphene drum 207 and upstream valve element 217 is maintained passively which allows the valve to close without causing mechanical wear between upstream valve graphene drum 207 and upstream valve element 217.

With respect to downstream valve 206, downstream valve element 218 can be utilized similarly.

In further embodiments, while not shown, standard silicon elements (such as transistors) can be integrated within or near the insulating material 103 near the respective graphene drums (main diaphragm graphene drum 201, upstream valve graphene drum 207, or downstream valve graphene drum 212) to help control the respective graphene drum and gate set.

FIG. 4 depicts another embodiment of a graphene-drum pump system illustrated in the PCT US11/23618 Application (described in paragraphs [00124]-[00127] and in FIG. 7-8, therein). FIG. 5 depicts the graphene-drum pump system of FIG. 4 with the graphene drum in a different position.

In FIGS. 4-5 (which are similar to FIGS. 7-8 of the PCT US11/23618 Application), an alternate embodiment of the present invention is shown that locates the graphene drum 201 such that the cavity 202 (in FIG. 2) is separated into two sealed cavities. (The change of position of graphene drum 201 is shown in FIGS. 4-5). Per the orientation of FIGS. 4-5, graphene drum 201 seals an upper cavity 401 and a lower cavity 402. As shown in FIGS. 4-5, upstream valve 205 and the downstream valve 206 are positioned to allow the pumping of fluid in and out of upper cavity 401.

As depicted in FIGS. 4-5, lower cavity 402 is oriented between the graphene drum 201 and the gate 203. Lower cavity 402 can be evacuated to increase the breakdown voltage between the graphene drum 201 and the gate 203. The maximum force (and thus the maximum graphene drum displacement) between the graphene drum 201 and the gate 203 increases as the square of this voltage. Thus, the pumping speed of the device 400 will increase significantly with an increase in the maximum allowable voltage.

As noted above, upper cavity 401 can be filled with air or some other gas/fluid that is being pumped. The vacuum in the lower cavity 402 can be created prior to mounting the graphene drum 201 over the main opening and maintained with a chemical getter. Small channels (not shown) between the lower cavities 402 could be routed to an external vacuum pump to create and maintain the vacuum. A set of dedicated graphene drum pumps mounted in the plurality of graphene drum pumps could also be used to create and maintain vacuum in the lower chambers (since pumping volume is so low these dedicated graphene drum pumps could operate with air in their lower chambers).

Similar to other embodiments shown in the PCT US11/23618 Application, in FIGS. 4-5, graphene drum 201 can act like a giant spring: i.e., once the gate 203 pulls graphene down (as shown in FIG. 4), when released the graphene drum 201 will spring upward (as shown in FIG. 5).

FIG. 6 depicts another embodiment of a graphene-drum pump system illustrated in the PCT US11/23618 Application (described in paragraphs [00129]-[00131] and in FIG. 9, therein). The graphene-drum pump system 600 shown in FIG. 6 can be actuated without requiring feedback as described above with respect to FIG. 2. In this embodiment, non-conductive member 604 (such as oxide) is placed between the graphene drum 201 and metallic gate 601 so that the graphene drum 201 cannot go into runaway mode and so that graphene drum 201 will not vigorously impact metallic gate 601 when seating. In embodiments of the invention, setting the graphene drum 201 (non-deflected) to metallic gate 901 distance to 20% of the diameter of the graphene drum 201 will prevent runaway (for a maximum deflection that is in the order of 10% of diameter of the graphene drum 201) and will allow the graphene drum 201 to seat softly on a surface of the non-conductive member 604 (such as oxide) without the need for feedback.

As shown in FIG. 6, when the graphene drum 201 is an open position, fluid can flow either (a) in inlet/outlet 602, through cavity 202, and out outlet/inlet 603 or (b) in outlet/inlet 603, through cavity 202, and out inlet/outlet 902 (due to the pressure differential between inlet/outlet 902 and outlet/inlet 903).

As shown in FIG. 6, the metallic gate 601 and metallic trace 605 have a non-conductive member 606 (such as oxide) between them. A voltage source 607 can be placed between the metallic gate 601 and the metallic trace 605 operatively connected to the graphene drum 201. The non-conductive member 604 physically prevents the graphene drum 201 and the metallic gate 601 from coming in contact with one another. This would prevent potentially damaging impacts of the graphene drum 201 and metallic gate 601.

While not illustrated here, in further embodiments of graphene-drum pump systems shown in the PCT US11/23618 Application, such systems can be designed to prevent the graphene drum and metallic gate from coming in contact. For instance, the graphene drum could be located at a distance such that its stiffness that precludes the graphene drum from being deflected to the degree necessary for it to come in contact with metallic gate. In such instance, the graphene drum would still need to be located such that it can be in the open position and the closed position. Or, a second and stabilizing system can be included in the embodiment of the invention that is operable for preventing the graphene drum from coming in contact with the gate.

Such embodiments of graphene-drum pump systems illustrated in the PCT US11/23618 Application can be used as a pump to displace fluid. As discussed in the PCT US11/23618 Application, this includes the use of such embodiments in a speaker, such as a compact audio speaker. While the graphene drums operate in the MHz range (i.e., at least about 1 MHz), the graphene drums can produce kHz audio signal by displacing air from one side and pushing it out the other (and then reversing the direction of the flow of fluid at the audio frequency). Utilizing such an approach: (a) provides the ability to make very low and very high pitch sounds with the same and very compact speaker; (b) provides the ability to make high volume sounds with a very small/light speaker chip; and (c) provides a little graphene speaker that would cool itself with high velocity airflow. Accordingly, these graphene-drum pump systems (of PCT US11/23618 Application) solve some of the problems of conventional speakers (such systems are efficient, compact, and can produce sound over the full range of audio frequencies without a loss of sound quality).

However, it has been found that such electrically conductive membrane transducers (of PCT US11/23618 Application) have limitations because these systems requires air to flow from the back of the chip/wafer to the front of the chip/wafer. Furthermore, these systems also require the valves to operate properly. Accordingly, there is a need to simplify the design of electrically conductive membrane transducers to reduce their complexity and cost. Furthermore, there is a need to reduce and/or eliminate the contacting and wear of the elements that occurs in these systems of PCT US11/23618 Application.

The two main advantages of the current graphene membrane transducer are that it can draw/push air in/out the same vents (allowing everything to be on one side of the chip/wafer if desired) and the system does not require valves to work. These two simplifications result in much lower complexity and cost. Also, there are no contacting/wear elements in the current invention. Since the graphene membrane transducer sends audio waves out from one face of a chip, there is no need to mount the device in a bulky enclosure (the backside of conventional cone speakers must be sealed to stop oppositely phased sound from canceling front-facing sound). If graphene membrane transducers assemblies are mounted on both sides of a chip, it is also possible to cancel reaction forces (by producing sound waves in phase from each side) and thus unwanted vibration.

SUMMARY OF THE INVENTION

The present invention relates to an electrically conductive membrane transducer. The electrically conductive membrane can be, for example, graphene membrane.

In general, in one aspect, the invention features an audio speaker that includes an electrically conductive membrane, a substrate, a cavity bounded at least in part by the substrate, an electrically conductive trace located near the electrically conductive membrane, and a time varying voltage between the electrically conductive membrane and the electrically conductive trace. The cavity has a volume that changes due to the movement of the electrically conductive membrane. The time varying voltage is operable for moving the electrically conductive membrane in a first direction and a second direction relative to the substrate. The movement of the electrically conductive membrane in the first direction is operable to cause air to be moved away from the substrate at a first average velocity. The movement of the electrically conductive membrane in the second direction is operable to cause air to be moved toward the substrate at a second average velocity. The first average velocity is greater than the second average velocity.

Implementations of the invention can include one or more of the following features:

The electrically conductive membrane can be less than 100 nm thick.

The electrically conductive membrane can be graphene.

The temperature of the air moving away from the substrate can be hotter than the temperature of the air moving toward the substrate.

The movement of the electrically conductive membrane in the first direction can be operable to compress the air in the cavity. The compression of the air in the cavity can be operable for heating the air.

The electrically conductive membrane can be operatively connected to a second voltage that can be applied to flow current through the electrically conductive membrane. The flow of the current through the electrically conductive membrane can heat the electrically conductive membrane by resistance heating. The air can be heated when it flows past the heated electrically conductive membrane.

The electrically conductive trace can include metal.

The electrically conductive trace can include silicon.

The time varying voltage can be operable for moving the electrically conductive membrane in a first direction and a second direction relative to the substrate during a plurality of cycle periods. Each of the cycle periods can include a first portion wherein the voltage is applied. Each of cycle periods can include a second portion wherein the voltage is reduced or terminated.

Each of the cycle periods can further include a third portion where the voltage is maintained at zero.

The third portion can be at least ten times longer than the first and second portions combined.

In each of the cycle periods, the second portion of the cycle period can be longer than the first portion of the cycle period.

In each of the cycle periods, the second portion of the cycle period can be shorter than the first portion of the cycle period.

Each of the cycle periods can take between around 0.01 microsecond and around 10 microseconds.

The combination of the first portion, second portion, and the third portion can create an audio signal that is in the range between around a 0.1 kHz audio wave and around a 20 kHz audio wave. The audio signal can be around a 1 kHz audio wave.

The audio speaker can further include a second metallic trace. The second electrically conductive trace can be positioned such that (i) when the electrically conductive membrane is moving toward the electrically conductive trace, the electrically conductive membrane is moving away from the second electrically conductive trace, and (ii) when the electrically conductive membrane is moving away from the electrically conductive trace, the electrically conductive membrane is moving toward the second electrically conductive trace. The electrically conductive membrane can be operable to move toward the second electrically conductive trace when a second voltage is applied between the electrically conductive membrane and the second electrically conductive trace.

The audio signals can be produced when the electrically conductive membrane is moving toward the second electrically conductive trace.

The audio signals can be produced when the electrically conductive membrane is moving toward the electrically conductive trace.

The electrically conductive membrane and the electrical conductive trace can form a portion of a sealed cavity. The sealed cavity can be a gas. The pressure of the gas can increase when the electrically conductive is moving toward the electrically conductive trace.

The audio speaker can be operable for cooling the air.

The audio speaker can be operable for producing a sound wave having a low density portion.

In general, in another aspect, the invention features a method to build a layered device having an enclosed void space. The method includes preparing a substrate having a first layer and a second layer. The method further includes removing a portion of the first layer from the substrate without removing a portion of the second layer from the substrate to form an open void space. The method further includes transferring graphene on top of the open void space. The method further includes depositing a material on top of the graphene to form the enclosed void space.

Implementations of the invention can include one or more of the following features:

The enclosed void space can be a channel.

The enclosed void space can be used to route a fluid.

The fluid can be a gas.

The gas can be air.

The method can further include the step of incorporating the substrate having the enclosed void space in a layered device.

In general, in another aspect, the invention features a method to produce an audio signal from an audio speaker, The method includes applying a first portion of a time varying voltage between an electrically conductive membrane in the audio speaker device and an electrically conductive trace in the audio speaker device to move the electrically conductive membrane in a first direction relative to the electrically conductive trace. During such movement of the electrically conductive membrane, air in a cavity of the audio speaker is exhausted from the cavity through a vent. The method further includes applying a second portion of a time varying voltage between the electrically conductive membrane in the audio speaker device and the electrically conductive trace in the audio speaker device to move the electrically conductive membrane in a second direction relative to the electrically conductive trace. During such movement of the electrically conductive membrane, air is drawn in through the vent into the cavity. The audio signal is produced by the exhausting of the air out of the cavity, the drawing in of the air into the cavity, or both.

In general, in one aspect, the invention features an audio speaker that includes an electrically conductive membrane, a substrate, a cavity bounded at least in part by the substrate, an electrically conductive trace located near the electrically conductive membrane, and a time varying voltage between the electrically conductive membrane and the electrically conductive trace. The cavity has a volume that changes due to the movement of the electrically conductive membrane. The time varying voltage is operable for moving the electrically conductive membrane in a first direction and a second direction relative to the substrate. The movement of the electrically conductive membrane in the first direction is operable to cause air to be moved away from the substrate at a first average temperature. The movement of the electrically conductive membrane in the second direction is operable to cause air to be moved toward the substrate at a second average temperature. The first average temperature is greater than the second average temperature.

Implementations of the invention can include one or more of the following features:

The difference between the first average temperature and the second average temperature can be at least 10° C.

The electrically conductive membrane can be less than 100 nm thick.

The electrically conductive membrane can be graphene.

In general, in another aspect, the invention features an electrically conductive membrane transducer. The electrically conductive membrane transducer includes an electrically conductive membrane, a gate metal layer, and a metallic trace. A first portion of the electrically conductive membrane rests upon the gate metal layer. The electrically conductive membrane is electrically connected to the gate metal layer. The electrically conductive membrane has a second portion that is operable to (A) move toward the metallic trace when a voltage is applied between the electrically conductive membrane and the metallic trace, and (B) move away from the metallic trace when the voltage is reduced or terminated. The movement of the second portion of the electrically conductive membrane is operable for displacing a fluid to produce an audio signal.

Implementations of the invention can include one or more of the following features:

A non-conductive member can be positioned between the gate metal layer and the metallic trace. The electrically conductive membrane, the metallic trace, and the non-conductive membrane can form a portion of a boundary of a cavity.

The electrically conductive membrane can be a graphene membrane.

The electrically conductive membrane can include graphene, graphene oxide, or both.

The fluid can be a gas.

The gas can be air.

The electrically conductive membrane transducer can further include a vent operably connected to the cavity such that fluid can be displaced from the cavity when the second portion of the electrically conductive membrane moves toward the metal trace.

The vent can be operably connected to the cavity such that fluid can return into the cavity when the second portion of the electrically membrane moves away from the metal trace.

The ratio of the cross sectional area of the electrically conductive membrane to the vent can be between about 10 to about 100.

The audio signal can be produced during the displacement of the fluid from the cavity.

The electrically conductive membrane transducer can be operable for moving the second portion of the electrically conductive membrane toward the metallic trace and away from the metallic trace during a plurality of cycle periods. Each of the cycle periods can include a first portion wherein the voltage is applied. Each of cycle periods can include a second portion wherein the voltage is reduced or terminated.

Each of the cycle periods can further include a third portion where the voltage is maintained at zero.

Each of the cycle periods can take around 1 microsecond.

The second portion of the cycle period can be at least two times longer than the first portion of the cycle period.

The second portion of the cycle period can be at least five times longer than the first portion of the cycle period.

Each of the cycle periods can takes between around 0.1 microsecond to around 2 microseconds.

The audio signal can be around a 1 kHz audio wave.

The audio signal can be at least around a 1 kHz audio wave.

The audio signal can be in the range between around a 0.1 kHz audio wave and around a 20 kHz audio wave.

The electrically conductive membrane transducer can further include a second metallic trace. The second metallic trace can positioned such that, when the second portion of the electrically conductive membrane is moving toward the metallic trace, the second portion of the electrically conductive membrane is moving away from the second metallic trace. The second metallic trace can positioned such that, when the second portion of the electrically conductive membrane is moving away from the metallic trace, the second portion of the electrically conductive membrane is moving toward the second metallic trace. The second portion of the electrically conductive membrane can be operable to move toward the second metallic trace when a second voltage is applied between the electrically conductive membrane and the second metallic trace.

The audio signals can be produced when the second portion of the electrically conductive membrane is moving toward the second metallic trace.

The audio signals can be produced when the second portion of the electrically conductive membrane is moving toward the metallic trace.

The electrically conductive membrane and the metallic trace can form a portion of a boundary of a sealed cavity. The sealed cavity can include a gas. The pressure of the gas can increase when the second portion of the electrically conductive is moving toward the metallic trace.

The electrically conductive membrane transducer can be operable for cooling the fluid.

The electrically conductive membrane transducer can be operable for producing a sound wave having a low density portion.

The electrically conductive membrane transducer can further include a second gate metal layer. A third portion of the electrically conductive membrane can rest upon the second gate metal layer. The electrically conductive membrane can be electrically connected to the second gate metal layer such that a second voltage can be applied to flow current from the gate metal layer, through the electrically conductive membrane, and to the second gate metal layer.

The electrically conductive membrane transducer can further comprise at least two vents. Fluid can be displaced through one or both of the vents.

The fluid can be displaced at a rate around 100 m/s.

The flow of the current can heat the electrically conductive membrane by resistance heating.

The fluid can be heated when it is flowed past the heated electrically conductive membrane.

The second voltage can be in the range of 0.1 to 10 MHz.

Implementations of the invention can include one or more of the following features:

The electrically conductive membrane transducer can be a piezoelectric transducer.

The fluid can be a liquid.

The electrically conductive membrane transducer can be a piezoelectric transducer that is operable for used in a liquid ultrasonic application.

The liquid ultrasonic application can include a medical imaging application.

In general, in another aspect, the invention features a method to build an electrically conductive membrane device having a void space. The method includes preparing a substrate having a first layer and a second layer. The first layer includes one or more layers of materials. The second layer includes one or more layers of materials. The method further includes removing a portion of the first layer from the substrate without removing a portion of the second layer from the substrate. The method further includes transferring an electrically conductive membrane onto a remaining portion of the first layer to create a void space between the electrically conductive membrane and the second layer.

Implementations of the invention can include one or more of the following features:

The method can further include depositing a third layer onto the electrically conductive membrane, wherein the third layer comprises one or more layers of materials.

The method can further include removing a portion of the third layer to expose the electrically conductive membrane.

The electrically conductive membrane device can be a electrically conductive membrane transducer.

In general, in another aspect, the invention features a method of producing an audio signal. The method includes moving a first portion of an electrically conductive membrane of an electrically conductive membrane transducer back and forth between a first position and a second position to displace a fluid to produce the audio signal. The electrically conductive membrane transducer includes the electrically conductive membrane and a metallic trace. The first portion of the electrically conductive membrane moves to the first position when a voltage is applied between the electrically conductive membrane and the metallic trace. The first portion of the electrically conductive membrane moves to the second position when the voltage is reduced or terminated.

Implementations of the invention can include one or more of the following features:

The electrically conductive membrane transducer can further include a gate metal layer. The second portion of the electrically conductive membrane can rest upon the gate metal layer. The electrically conductive membrane can be electrically connected to the gate metal layer. The first portion of the electrically conductive membrane can move toward the metallic trace when moving to the first position. The first portion of the electrically conductive membrane can move away from the metallic trace when moving to the second position.

The electrically conductive membrane transducer can further comprise a non-conductive member positioned between the gate metal layer and the metallic trace. The electrically conductive membrane, the metallic trace, and the non-conductive membrane can form a portion of a boundary of a cavity.

The electrically conductive membrane can be a graphene membrane.

The electrically conductive membrane can include graphene, graphene oxide, or both.

The fluid can be a gas. The gas can be air.

The fluid can be displaced from the cavity when the first portion of the electrically conductive membrane moves to the first position.

The fluid can return into the cavity when the first portion of the electrically membrane moves to the second position.

The fluid can be displaced from the cavity through a vent. The ratio of the cross sectional area of the electrically conductive membrane to the vent can be between about 10 to about 100.

The audio signal can be produced during the displacement of the fluid from the cavity.

The first portion of the electrically conductive membrane can move back and forth between the first position and the second position during each cycle period in a plurality of cycle periods. Each of the cycle periods can include a first portion wherein the voltage is applied. Each of the cycle period can include a second portion wherein the voltage is reduced or terminated.

Each of the cycle periods can further include a third portion where the voltage is maintained at zero.

Each of the cycle periods can take around 1 microsecond.

In each of the cycle periods, the second portion of the cycle period can be at least two times longer than the first portion of the cycle period.

In each of the cycle periods, the second portion of the cycle period can be at least five times longer than the first portion of the cycle period.

Each of the cycle periods can take between around 0.1 microsecond and around 2 microseconds.

The audio signal can be around a 1 kHz audio wave.

The audio signal can be at least around a 1 kHz audio wave.

The audio signal can be in the range between around a 0.1 kHz audio wave and around a 20 kHz audio wave.

The electrical conductive membrane transducer can further include a second metallic trace. When the first portion of the electrically conductive membrane is moving to the first position, the first portion of the electrically conductive membrane can be moving away from the second metallic trace. When the first portion of the electrically conductive membrane is moving to the second position, the first portion of the electrically conductive membrane can be moving toward the second metallic trace. The second portion of the electrically conductive membrane can move toward the second metallic trace when a second voltage is applied between the electrically conductive membrane and the second metallic trace.

The audio signals can be produced when the first portion of the electrically conductive membrane is moving toward the second metallic trace.

The audio signals can be produced when the first portion of the electrically conductive membrane is moving toward the metallic trace.

The electrically conductive membrane and the metallic trace can form a portion of a boundary of a sealed cavity. The sealed cavity can include a gas. The pressure of the gas can increase when the first portion of the electrically conductive is moving toward the metallic trace.

The electrically conductive membrane transducer can cool the fluid.

The electrically conductive membrane transducer can produce a sound wave having a low density portion.

The electrically conductive membrane transducer can further include a second gate metal layer. A third portion of the electrically conductive membrane can rest upon the second gate metal layer. A second voltage can flow current from the gate metal layer, through the electrically conductive membrane, and to the second gate metal layer.

The electrically conductive membrane transducer can further include at least two vents. Fluid can be displaced through one or both of the vents.

The fluid can be displaced at a rate around 100 m/s.

The electrically conductive membrane can be heated by the second voltage current flow. The heating can be resistance heating.

The fluid can be heated when it flows past the heated electrically conductive membrane.

The second voltage can be in the range of 0.1 to 10 MHz.

The electrically conductive membrane transducer can be a piezoelectric transducer.

The fluid can be a liquid.

The electrically conductive membrane transducer can be a piezoelectric transducer. The piezoelectric transducer can be used in a liquid ultrasonic application.

The liquid ultrasonic application can include a medical imaging application.

In general, in another aspect, the invention features a pump. The pump includes one or more electrically conductive membranes. The pump further includes a cavity bounded at least in part by a substrate. The cavity has a volume that changes due to the movement of the one or more electrically conductive membranes. The pump further includes a venturi channel operatively connected to the cavity. The venturi channel is operatively connected to a venturi orifice. The pump further includes an outlet orifice operatively connected to the venturi channel. The pump further includes an electrically conductive trace located near the one or more electrically conductive membranes. The pump further includes a time varying voltage between the one or more electrically conductive membranes and the electrically conductive trace. The time varying voltage is operable for moving the one or more electrically conductive membranes in a first direction and a second direction relative to the substrate. The combined movement of the one or more electrically conductive membranes in a first and second direction is operable to cause a fluid to enter the venturi orifice and exit the outlet orifice.

Implementations of the invention can include one or more of the following features:

The one or more electrically conductive membranes can each be less than 100 nm thick.

The one or more electrically conductive membranes can include graphene.

The electrically conductive trace can include metal.

The electrically conductive trace can include silicon.

The time varying voltage can be operable for moving the one or more electrically conductive membranes in a first direction and a second direction relative to the substrate during a plurality of cycle periods. Each of the cycle periods can include a first portion wherein the voltage is applied. Each of cycle periods can include a second portion wherein the voltage is reduced or terminated.

In each of the cycle periods, the second portion of the cycle period can be longer than the first portion of the cycle period.

In each of the cycle periods, the second portion of the cycle period can be shorter than the first portion of the cycle period.

The fluid can be air.

In general, in another aspect, the invention features an audio speaker. The audio speaker includes one or more electrically conductive membranes. The audio speaker further includes a cavity bounded at least in part by a substrate. The cavity has a volume that changes due to the movement of the one or more electrically conductive membranes. The audio speaker further includes a venturi channel operatively connected to the cavity. The venturi channel is operatively connected to a venturi orifice. The audio speaker further includes an outlet orifice operatively connected to the venturi channel. The audio speaker further includes an electrically conductive trace located near the one or more electrically conductive membranes. The audio speaker further includes a time varying voltage between the one or more electrically conductive membranes and the electrically conductive trace. The time varying voltage has an ultrasonic frequency. The time varying voltage is operable for moving the one or more electrically conductive membranes in a first direction and a second direction relative to the substrate. The combined movement of the one or more electrically conductive membranes in a first and second direction is operable to cause air to enter the venturi orifice and exit the outlet orifice at an average flow rate. The average airflow rate is varied between 20 Hz and 20 kHz to produce an audible sound.

Implementations of the invention can include one or more of the following features:

The one or more electrically conductive membranes can each be less than 100 nm thick.

The one or more electrically conductive membranes can include graphene.

The electrically conductive trace can include metal.

The electrically conductive trace can include silicon.

The time varying voltage can be operable for moving the electrically conductive membrane in a first direction and a second direction relative to the substrate during a plurality of cycle periods. Each of the cycle periods can include a first portion wherein the voltage is applied. Each of cycle periods can include a second portion wherein the voltage is reduced or terminated.

In each of the cycle periods, the second portion of the cycle period can be longer than the first portion of the cycle period.

In each of the cycle periods, the second portion of the cycle period can be shorter than the first portion of the cycle period.

Each of the cycle periods can take between around 0.01 microsecond and around 10 microseconds.

The audio signal can be around a 1 kHz audio wave.

The audio speaker can include a second metallic trace. The second electrically conductive trace can be positioned such that when the electrically conductive membrane is moving toward the electrically conductive trace, the electrically conductive membrane is moving away from the second electrically conductive trace. The second electrically conductive trace can be positioned such that when the electrically conductive membrane is moving away from the electrically conductive trace, the electrically conductive membrane is moving toward the second electrically conductive trace. The second electrically conductive trace can be positioned such that the electrically conductive membrane is operable to move toward the second electrically conductive trace when a second voltage is applied between the electrically conductive membrane and the second electrically conductive trace.

DESCRIPTION OF DRAWINGS

FIG. 9A illustrates the graphene membrane transducer before an electrostatic forces are applied. FIG. 9B illustrates the graphene membrane transducer when the graphene membrane is being pulled toward the conductive trace due to electrostatic forces.

FIG. 9C illustrates the graphene membrane transducer after the electrostatic forces applied in FIG. 9B are reduced or eliminated.

FIG. 13A illustrates the graphene membrane transducer when the graphene membrane is being pulled toward the conductive trace due to electrostatic forces. FIG. 13B illustrates the graphene membrane transducer after the electrostatic forces applied in FIG. 13A are reduced or eliminated.

FIG. 16A illustrates the graphene membrane transducer when the graphene membrane is being pulled toward the conductive bottom trace due to electrostatic forces. FIG. 16B illustrates the graphene membrane transducer after the electrostatic forces applied in FIG. 16A are reduced or eliminated and when the graphene membrane is being pulled toward the top trace due to electrostatic forces.

FIG. 22A illustrates the graphene membrane transducer when the graphene membrane is being pulled toward the conductive trace due to electrostatic forces. FIG. 22B illustrates the graphene membrane transducer after the electrostatic forces applied in FIG. 22A are reduced or eliminated.

DETAILED DESCRIPTION

The present invention relates to an improved electrically conductive membrane transducer, such as, for example, an improved graphene membrane transducer. The improved electrically conductive membrane transducer does not require air (or other fluid) to flow from the back of the chip/wafer to the front of the chip/wafer. Furthermore, the improved electrically conductive membrane does not require valves to operate. Other advantages of the present invention is that the electrically conductive membrane transducer can draw/push air in/out the same vents (allowing everything to be on one side of the chip/wafer if desired). These simplifications result in much lower complexity and cost.

Also, there is no contacting/wear elements in the current invention.

Moreover, the electrically conductive membrane transducer sends audio waves out from one face of a chip; thus there is no longer any requirement to mount the device in a bulky enclosure (the backside of conventional cone speakers must be sealed to stop oppositely phased sound from canceling front-facing sound).

Furthermore, it is also possible to cancel reaction forces (by producing sound waves in phase from each side) and thus unwanted vibration, by mounting the electrically conductive membrane transducer assemblies on both sides of a chip.

In the preceding and following discussion of the present invention, the electrically conductive membrane of the electrically conductive membrane transducer will be a graphene membrane. However, a person of skill in the art of the present invention will understand that other electrically conductive membranes can be used in place of, or in addition to, graphene membranes (such as in graphene oxide membrane and graphene/graphene oxide membranes).

Figure 7:
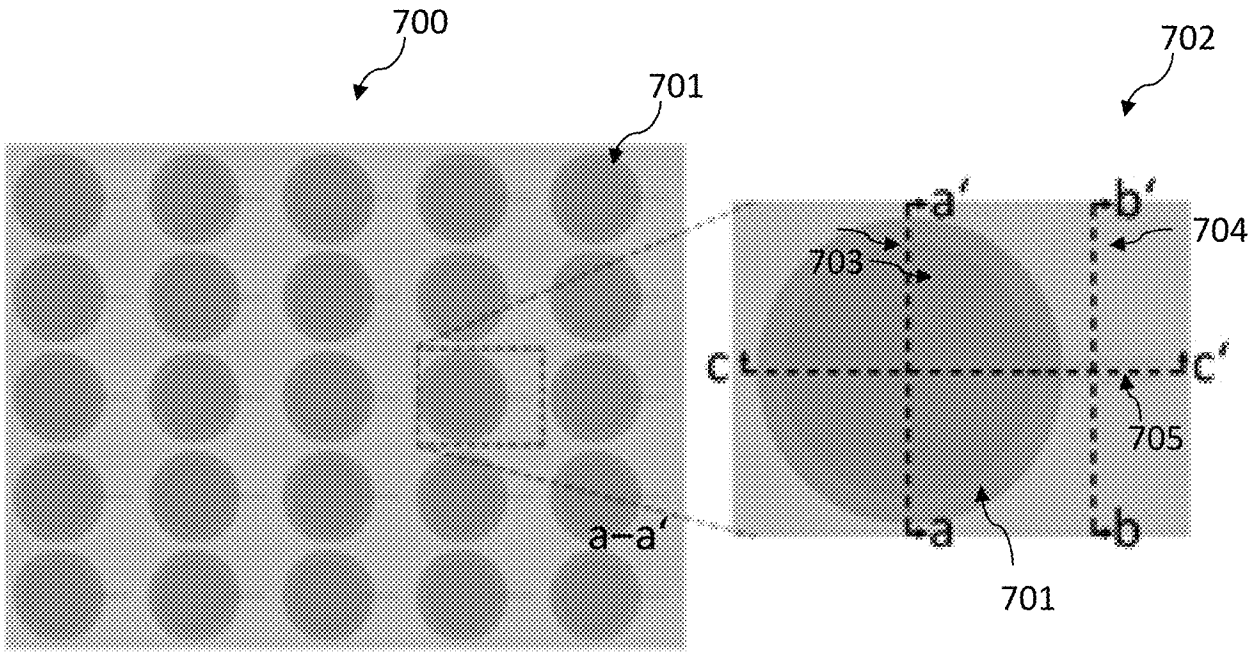
FIG. 7 illustrates an array of graphene membrane transducers of the present invention, which includes a magnified illustrated view of one of the graphene membrane transducers.

Referring to the figures, FIG. 7 illustrates an array 700 of graphene membrane transducers 701, which includes a magnified illustrated view 702 of one of the graphene membrane transducers 701. Magnified illustrated view 702 provides dotted lines 703, 704, and 705, which define a cross section a-a', b-b', c-c', respectively.

Figure 1:
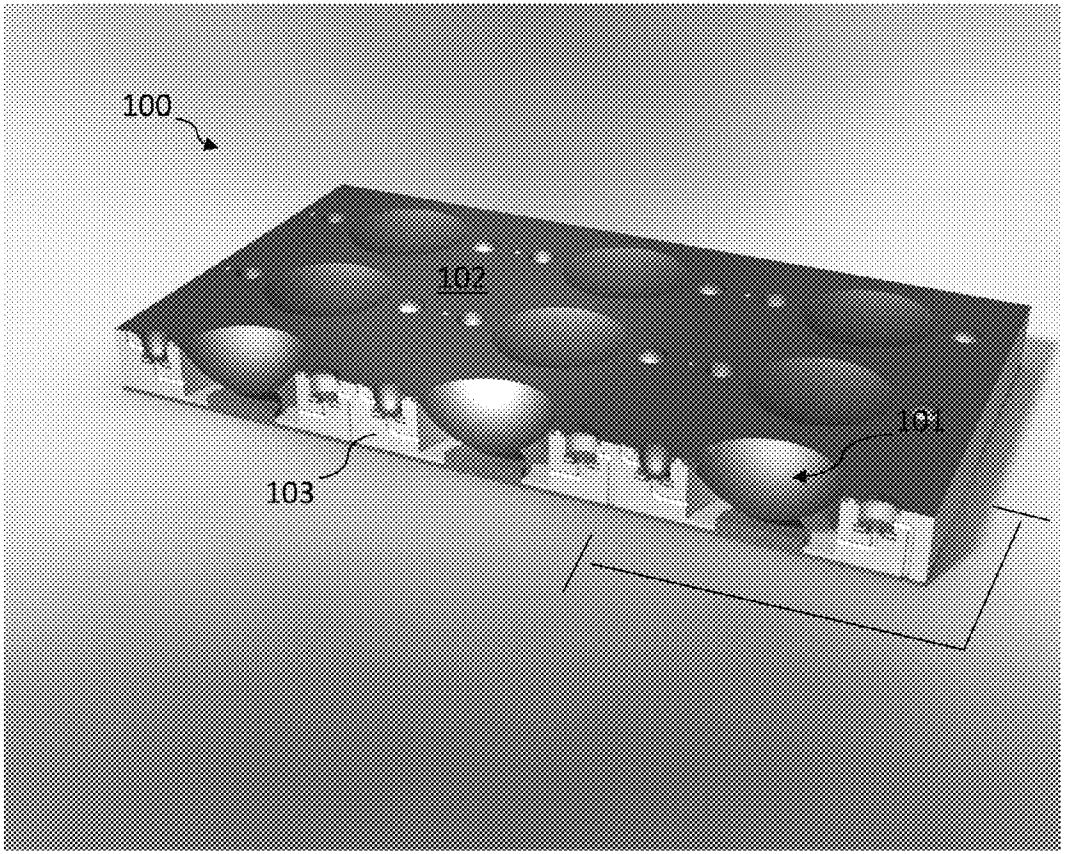
FIG. 1 depicts a perspective view of a graphene-drum pump system illustrated in PCT US11/23618 Application.
Figure 2:
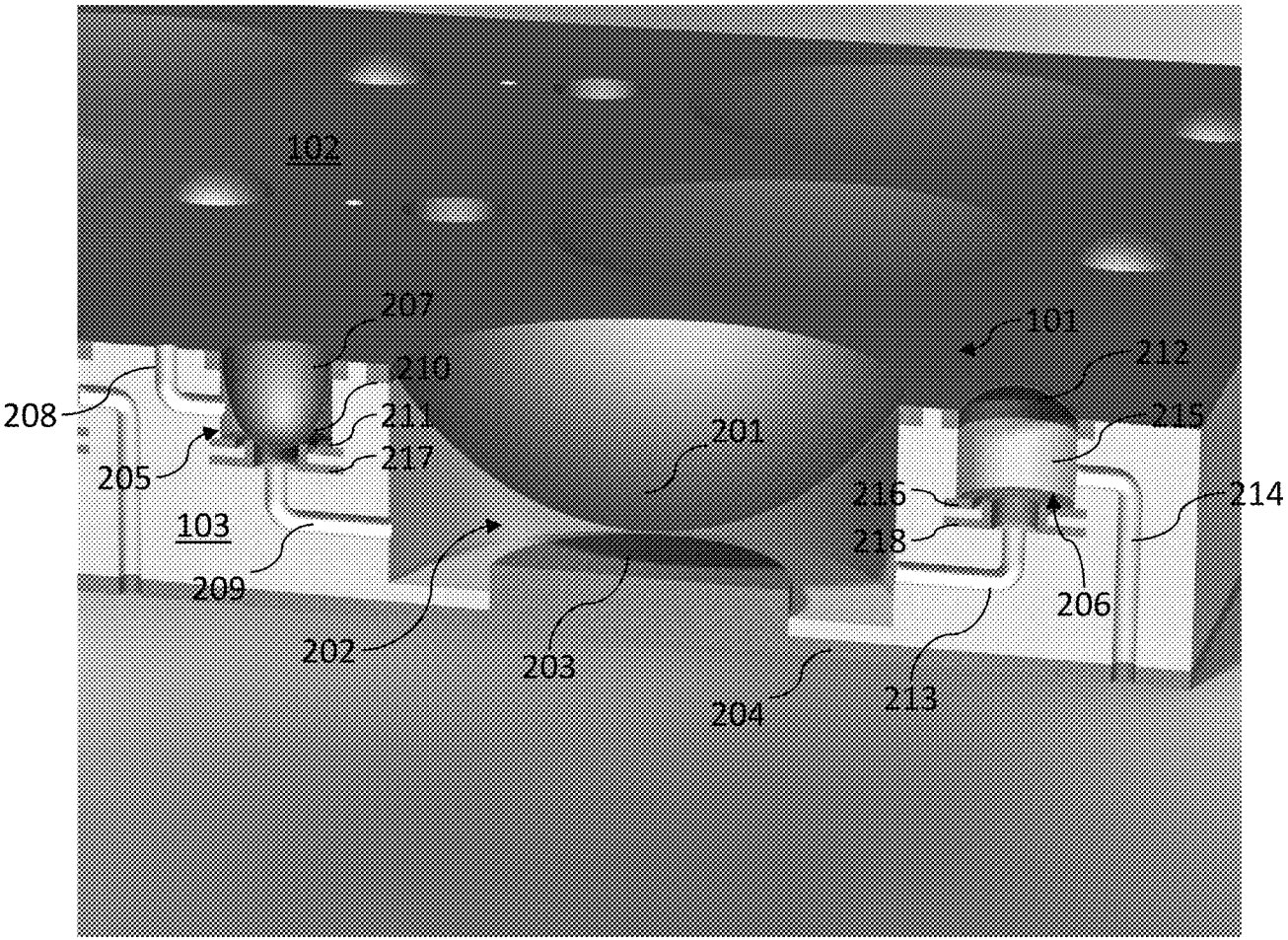
FIG. 2 depicts a close-up of a graphene-drum pump (in the graphene-drum pump system of FIG. 1) in exhaust mode.
Figure 3:
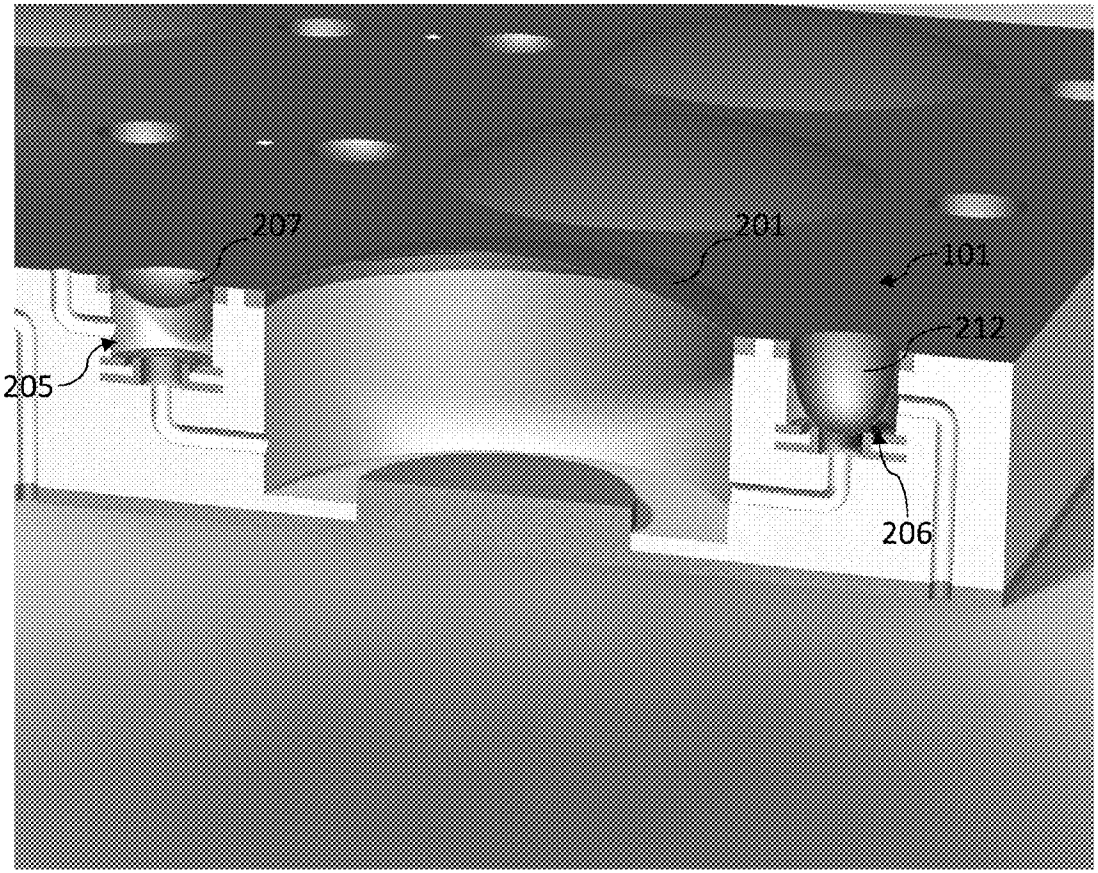
FIG. 3 depicts a close-up of a graphene-drum pump (in the graphene-drum pump system of FIG. 1) in intake mode.
Figure 4:
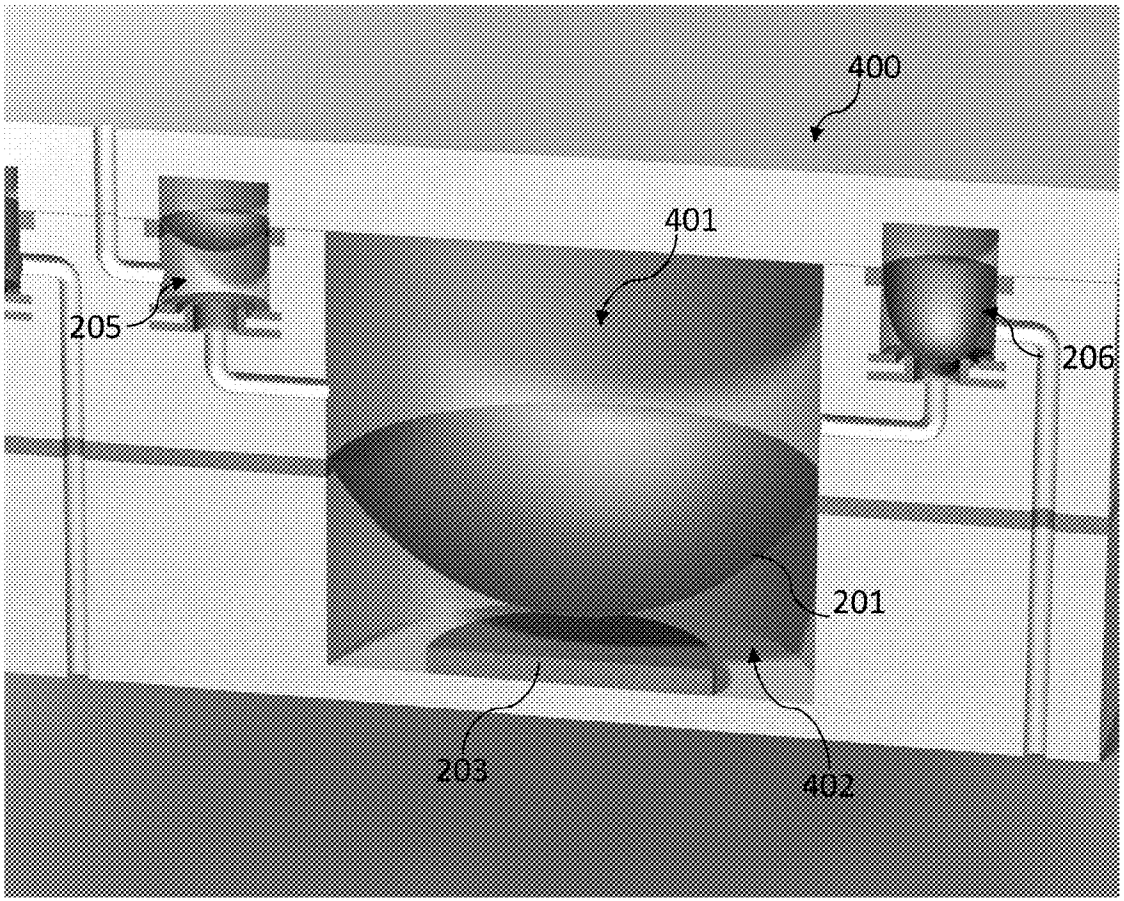
FIG. 4 depicts an alternative embodiment of a graphene-drum pump system.
Figure 5:
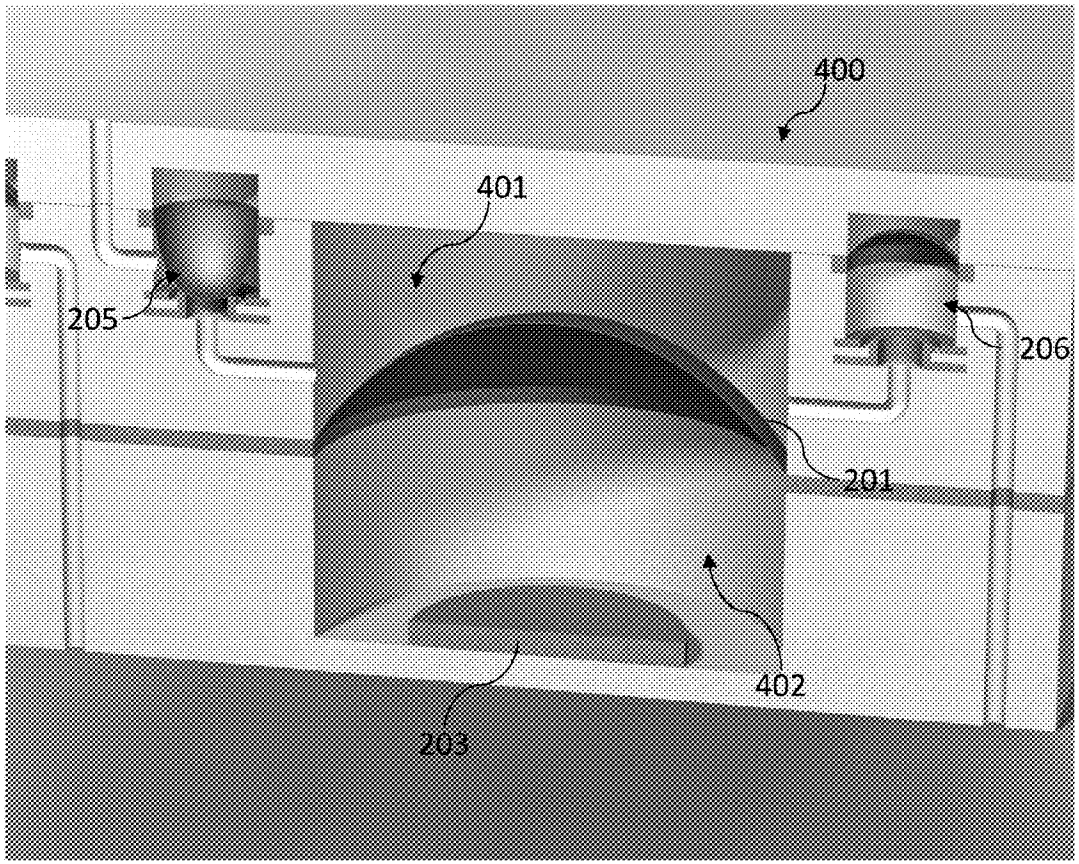
FIG. 5 depicts the graphene-drum pump system of FIG. 4 with the graphene drum in a different position.
Figure 6:
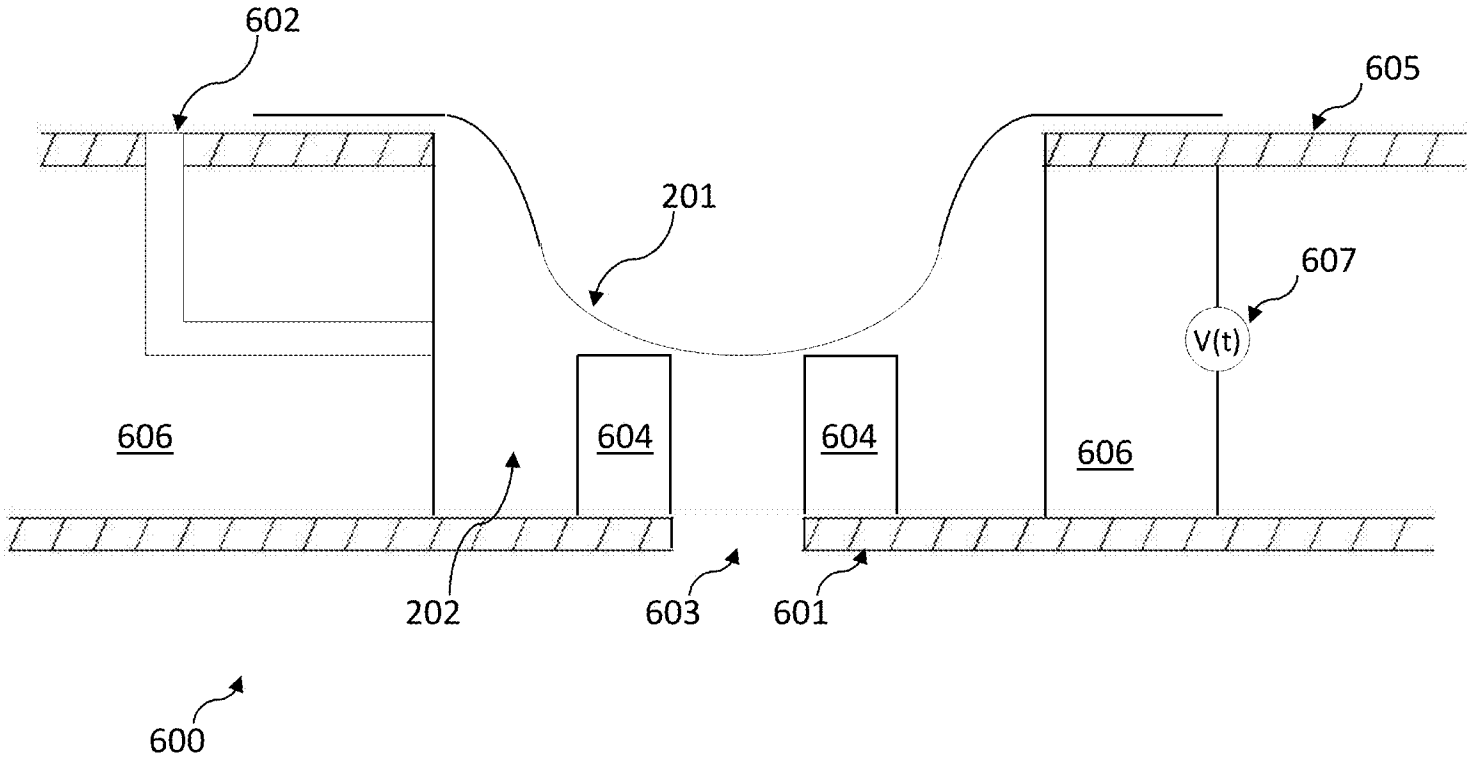
FIG. 6 depicts a further alternative embodiment of a graphene-drum pump system.
Figure 8A:
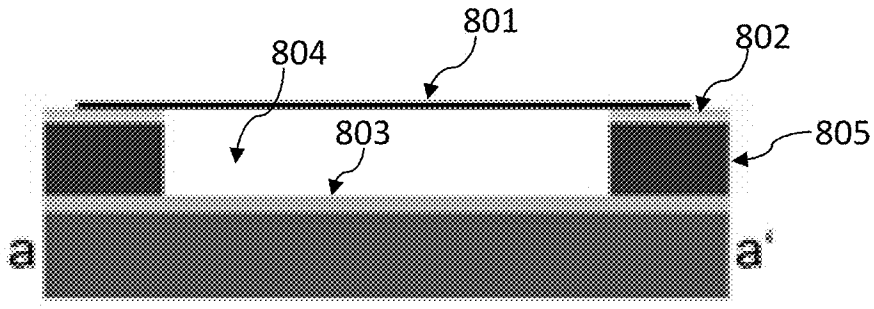
FIG. 8A depicts a cross-sectional (a-a') illustration of the magnified graphene membrane transducer illustrated in FIG. 7.

FIG. 8A depicts the cross-sectional (a-a') illustration of the magnified graphene membrane transducer 701 illustrated in FIG. 7. As shown in FIG. 8A, a graphene membrane 801 rests upon and is electrically connected to metallic gate 802. As shown in the orientation of FIG. 8A, the center portion of graphene membrane 801 is above a metallic trace 803 with a cavity 804 between the center of graphene membrane 801 and metallic trace 803. As shown in FIG. 6, the metallic gate 802 and metallic trace 803 have a non-conductive member 805 (such as oxide) between them.

Figure 8B:
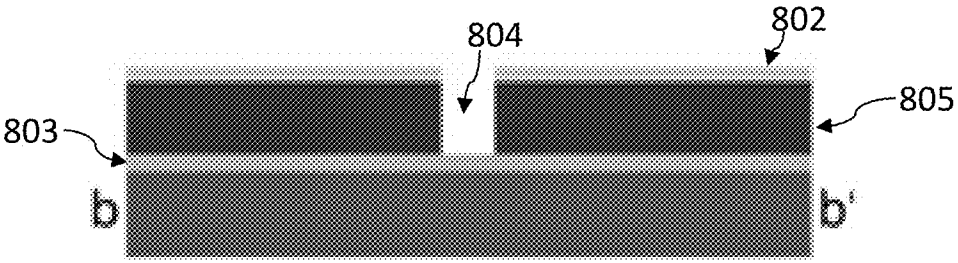
FIG. 8B depicts a cross-sectional (b-b') illustration of the magnified graphene membrane transducer illustrated in FIG. 7.

FIG. 8B depicts a cross-sectional (b-b') illustration of the magnified graphene membrane transducer illustrated in FIG. 7.

Figure 8C:
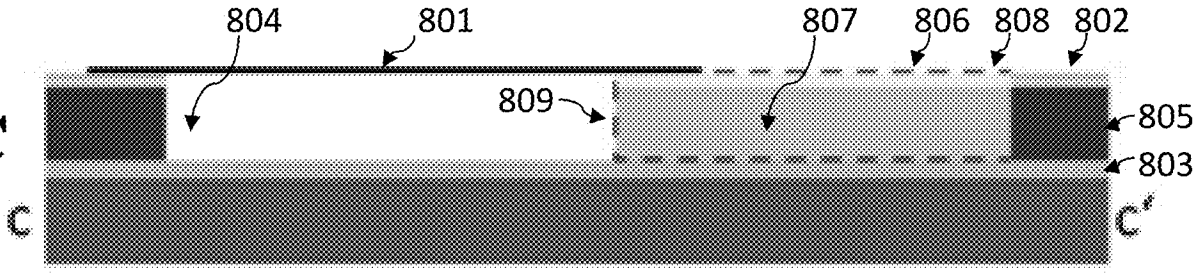
FIG. 8C depicts a cross-sectional (c-c') illustration of the magnified graphene membrane transducer illustrated in FIG. 7.

FIG. 8C depicts a cross-sectional (c-c') illustration of the magnified graphene membrane transducer illustrated in FIG. 7. Per the orientation of FIG. 8C, cavity 804 is in fluid communication with cavity 807 by vented wall 809, and cavity 807 is also bounded by top 806 with vent holes 808. (Per the orientation of FIG. 8C, the vent holes 808 are at the top of cavity 807).

Figure 9A:
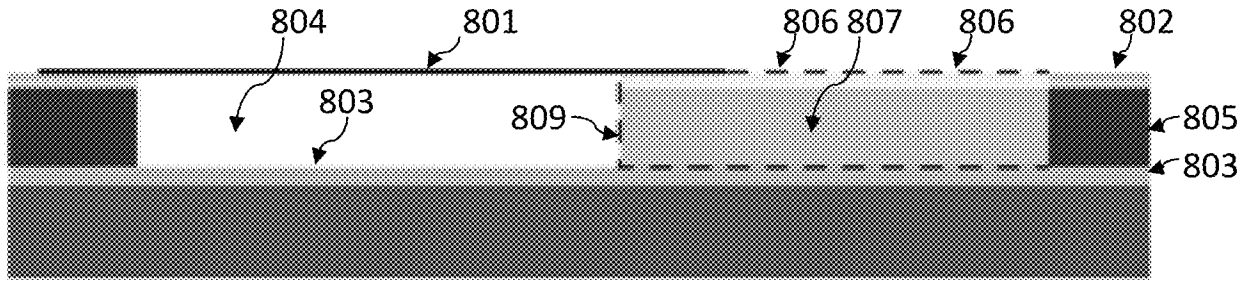
FIGS. 9A-9C depict an illustration of a graphene membrane transducer (illustrated in FIG. 7) that shows how the graphene membrane moves to cause fluid flow.
Figure 9B:
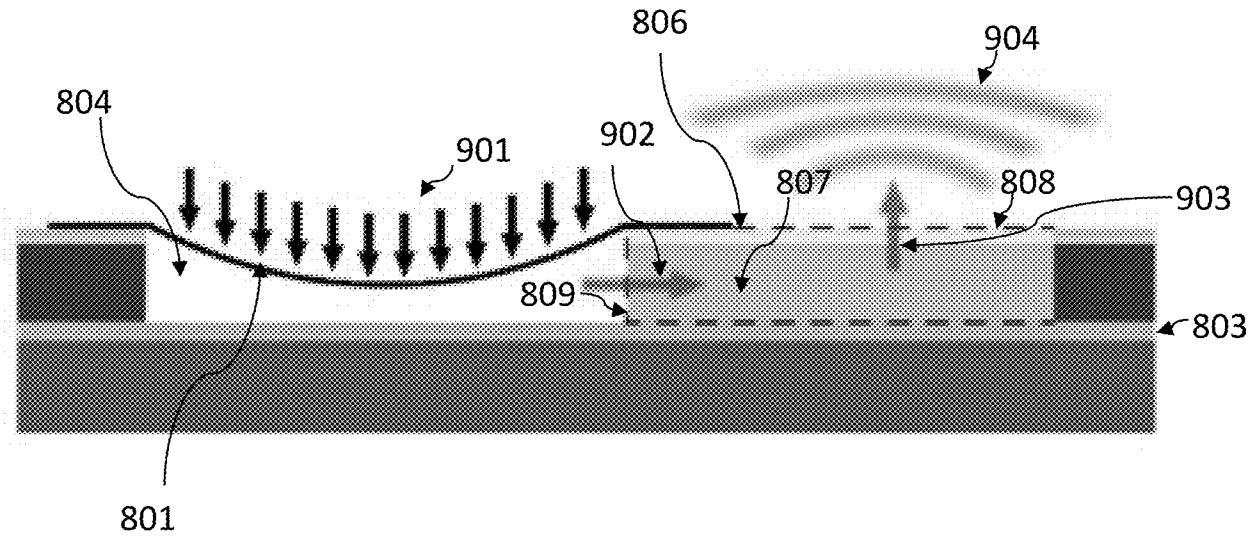
Figure 9C:
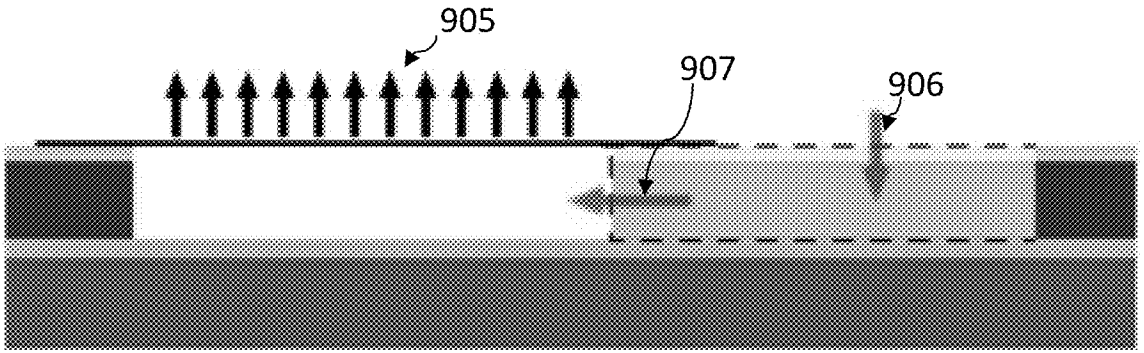

FIGS. 9A-9C depict an illustration of a graphene membrane transducer 701 (illustrated in FIG. 7) that shows how the graphene membrane moves to cause fluid flow. FIG. 9A is the same view as FIG. 8C and illustrates the graphene membrane transducer 701 before an electrostatic forces are applied. As shown in FIG. 9A, the center of graphene membrane 801 is not deflected.

FIG. 9B illustrates the graphene membrane transducer 701 when the graphene membrane 801 is being pulled toward metal trace 803 due to electrostatic forces. In the orientation shown in FIG. 9B, the graphene membrane 801 is being deflected down toward metal trace 803 (as shown by arrows 901). A voltage between the electrically conductive trace 803 and graphene membrane 801 is used to rapidly deflect the graphene membrane 801 downward. This deflection reduces the volume of cavity 804, thereby causing a fluid to flow from cavity 804 to cavity 807 via vented wall 809, as shown by arrow 902. This fluid flow thereby pushes fluid outside cavity 807, via vents 808 of top 806, as shown by arrow 903, which produces waves 904.

In an alternative embodiment, cavity 804 and cavity 807 are not separated by wall 809 (i.e., cavity 804 and cavity 807 are the same cavity).

In a further embodiment, wall 809 is not vented, but rather a membrane that can deflect (i.e., cavity 804 and cavity 807 are isolated from one another). In such instance, when graphene membrane 801 is deflected downward, the increase in pressure inside chamber 804 caused wall 809 to deflect into cavity 807, thereby raising the pressure inside cavity 807. This increased pressure thereby causes fluid to be pushed outside cavity 807, via vents 808 of top 806, as shown by arrow 903, which produces waves 904.

FIG. 9C illustrates the graphene membrane transducer 701 after the electrostatic forces applied in FIG. 9B are reduced or eliminated. When the voltage between the electrically conductive trace 803 and graphene membrane 801 is reduced or eliminated, the graphene membrane 801 will move back to its original position (as shown by arrows 905). When doing so, the decrease in pressure inside cavity 804 (and thereby cavity 807) will allow for the fluid to flow back into cavity 807 and cavity 804, as shown by arrows 906 and 907, respectively. Generally, the rate of this flow back is relatively slow, as compared to the rate at which the fluid flowed out as shown in FIG. 9B.

Figure 10:
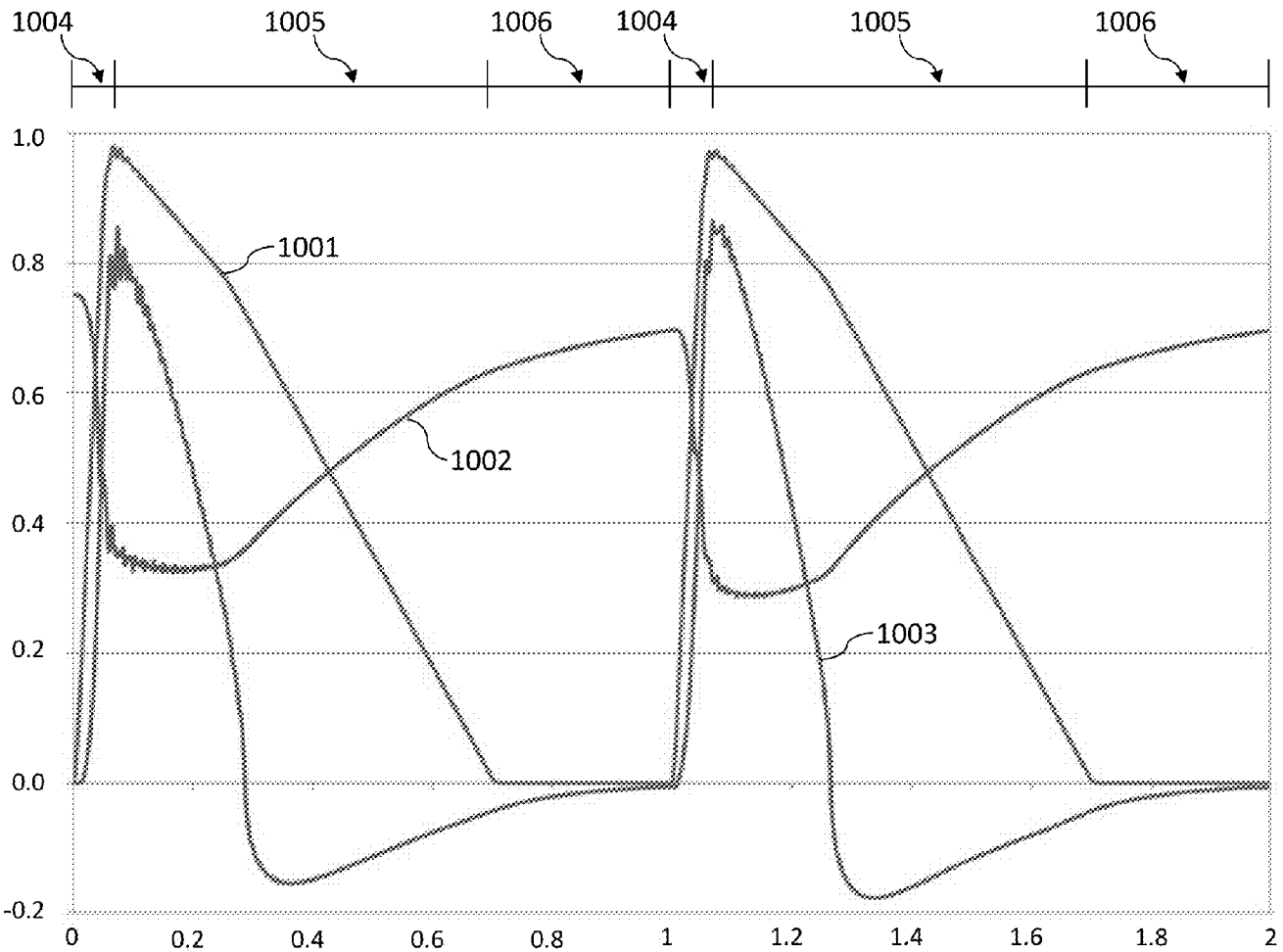
FIG. 10 depicts a normalized graph that shows how the gate voltage, graphene membrane height, and audio power change over a two cycle period in an embodiment of the present invention.

FIG. 10 depicts a graph that shows how the gate voltage, graphene membrane height, and audio power change over a two cycle period in an embodiment of the present invention. Gate voltage, graphene membrane height, and audio power are shown in normalized curves 1001, 1002, and 1003, respectively. (These curves have been normalized so that they can be shown on the same graph). The graphene height is the height of the graphene membrane 801 measured relative to the metallic trace 803 (as shown in FIGS. 9A-9C).

The first cycle includes (a) a period 1004 in which in which the gate voltage is rapidly increased, (b) a period 1005 in which the gate voltage is more slowly reduced back to zero, and (c) a period 1006 in which the gate voltage is maintained at zero. The second cycle repeats these periods 1004, 1005, and 1006.

When rapidly increasing the gate voltage during period 1004, the graphene membrane 801 is pulled down rapidly (toward metallic trace 803). When more slowly reducing the gate voltage in period 1005, graphene membrane 801 is let up more slowly. Thus, by shaping the gate voltage appropriately, the rate of movement upward and downward of the graphene membrane is controlled.

Curve 1003 shows how the expelled air power (a combination of the net velocity of the air molecules and the elevated temperature of the expelled air molecules) or audio power is high during the first part of the cycle (peaking at the end of period 1004) and then actually goes negative around a third of the way through the cycle. The reason the air/audio power is negative during the air intake part of the cycle is because the intake air is being cooled as cavity 804 expands. As you can be seen from the relative height of the pulses, the net audio power is positive.

If each of these cycles takes one microsecond, it would take 500 of these cycles to build up the high pressure part of a 1 kHz audio wave. The graphene membrane transducer array (such as array 700) may be driven harder during certain parts of the 500 cycles (and some graphene membrane transducers may be out of phase with other graphene membrane transducers) to better approximate a smooth audio wave.

Figure 11:
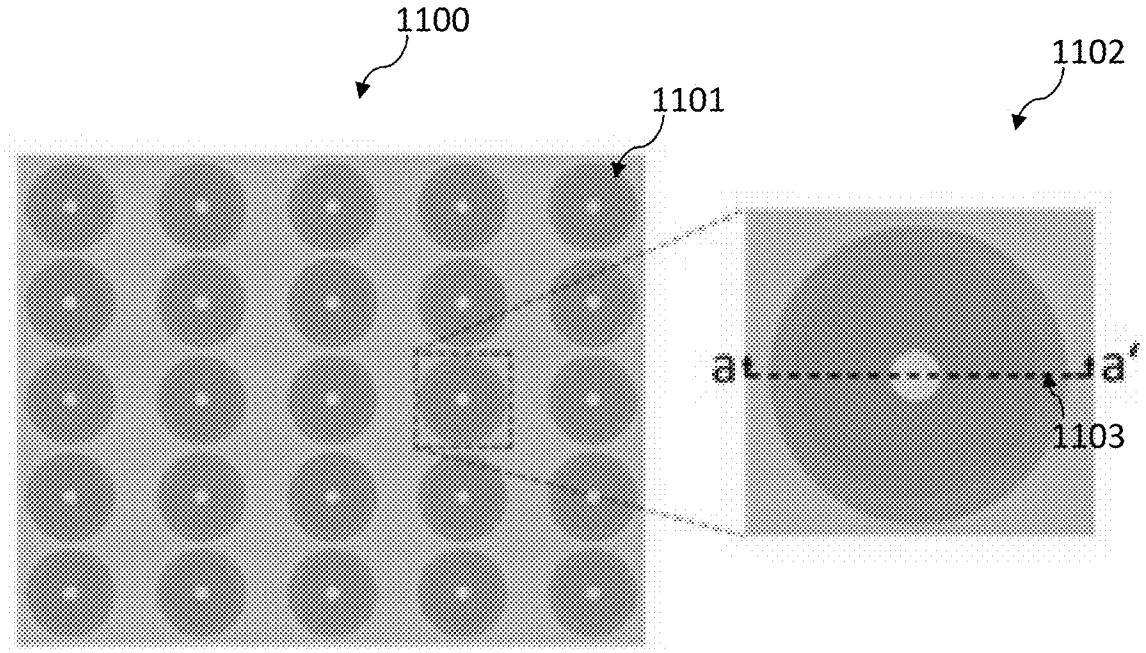
FIG. 11 illustrates an alternative array of graphene membrane transducers of the present invention, which includes a magnified illustrated view of one of the graphene membrane transducers.

FIG. 11 illustrates an array 1100 of alternative graphene membrane transducers 1101, which includes a magnified illustrated view 1102 of one of the graphene membrane transducers 1101. Magnified illustrated view 1102 provides dotted line 1103, which defines a cross section a-a'.

Figure 12:
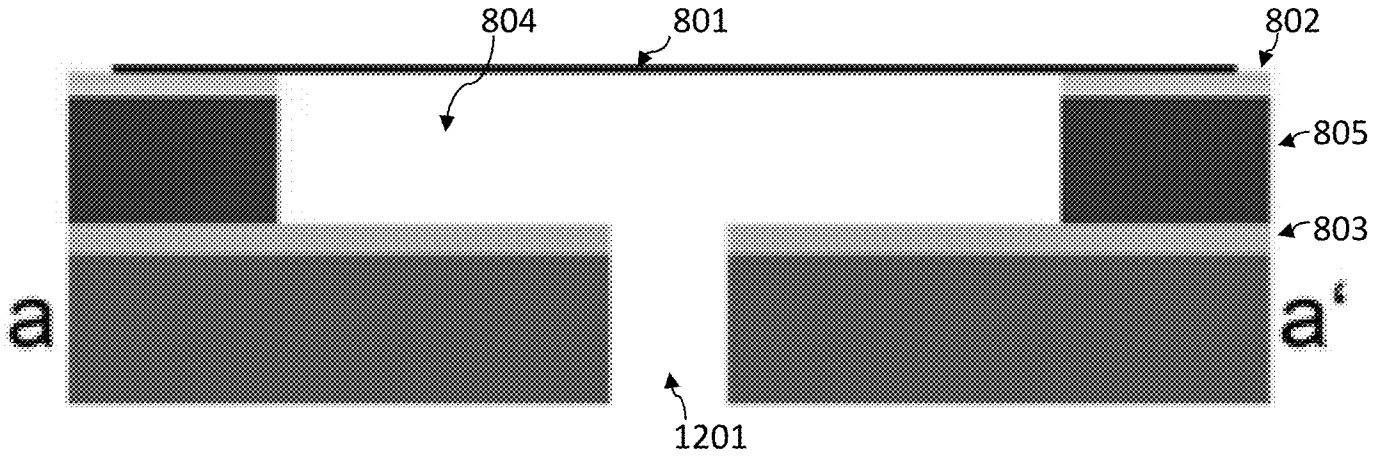
FIG. 12 depicts a cross-sectional (a-a') illustration of the magnified graphene membrane transducer illustrated in FIG. 11.

FIG. 12 depicts the cross-sectional (a-a') illustration of the magnified graphene membrane transducer 1101 illustrated in FIG. 11. Similar to graphene membrane transducer 701, graphene membrane transducer 1101 has graphene membrane 801, metallic gate 802, metallic trace 803, cavity 804, and non-conductive member 805. As shown in FIG. 12, graphene membrane transducer 1101 also has a vent hole 1201 through which fluid may flow out of cavity 804. By this arrangement of vent hole 1201, the density of graphene membrane transducers 1101 can be increased in array 1100 (as compared to the density of graphene membrane transducers 701 in array 700).

Figure 13A:
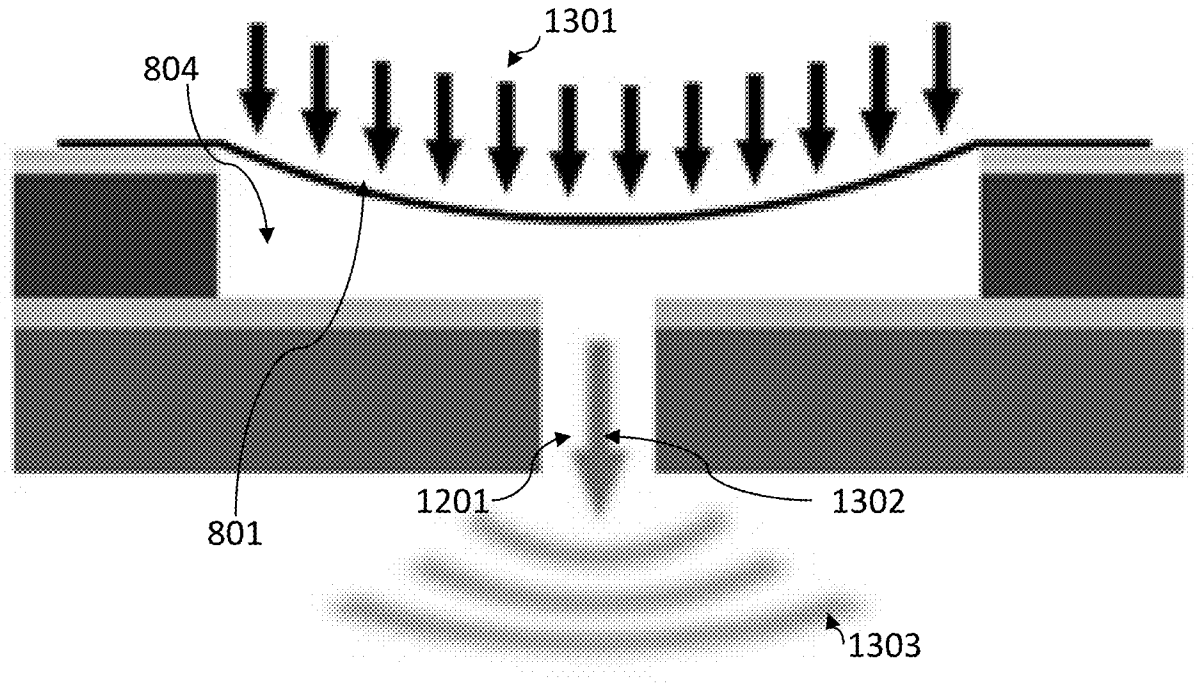
FIGS. 13A-13B depict an illustration of a graphene membrane transducer (illustrated in FIG. 11) that shows how the graphene membrane moves to cause fluid flow.

FIG. 13A illustrates the graphene membrane transducer 1101 when the graphene membrane 801 is being pulled toward metal trace 803 due to electrostatic forces. In the orientation shown in FIG. 13A, the graphene membrane 801 is being deflected down toward metal trace 803 (as shown by arrows 1301). As with graphene membrane transducer 701, a voltage between the electrically conductive trace 803 and graphene membrane 801 is used to rapidly deflection the graphene membrane 801 downward. This deflection reduces the volume of cavity 804, thereby causing a fluid to flow out of cavity 804 through vent hole 1201, as shown by arrow 1302, which produces waves 1303.

Figure 13B:
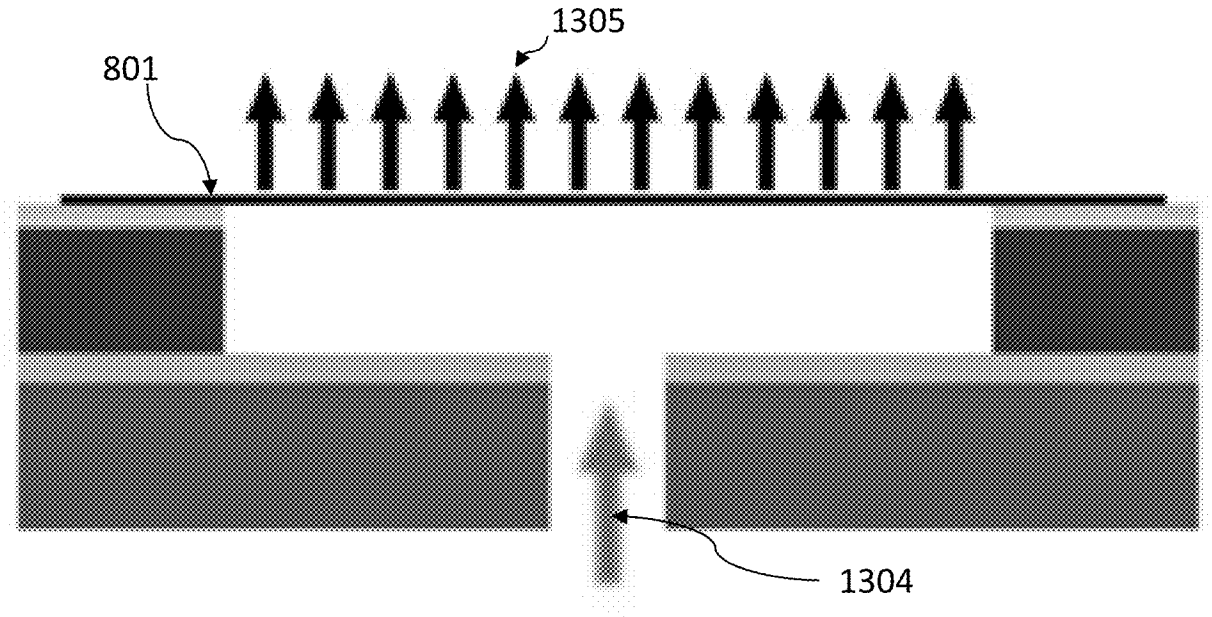

FIG. 13B illustrates the graphene membrane transducer 1001 after the electrostatic forces applied in FIG. 13A are reduced or eliminated. When the voltage between the electrically conductive trace 803 and graphene membrane 801 is reduced or eliminated, the graphene membrane 801 will move back to its original position (as shown by arrows 1305). When doing so, the decrease in pressure inside cavity 804 will allow for the fluid to flow back into cavity 804, as shown by arrow 1304. Similar to graphene membrane transducer 701, generally, the rate of this flow back is relatively slow, as compared to the rate at which the fluid flowed out as shown in FIG. 13A.

Figure 14:
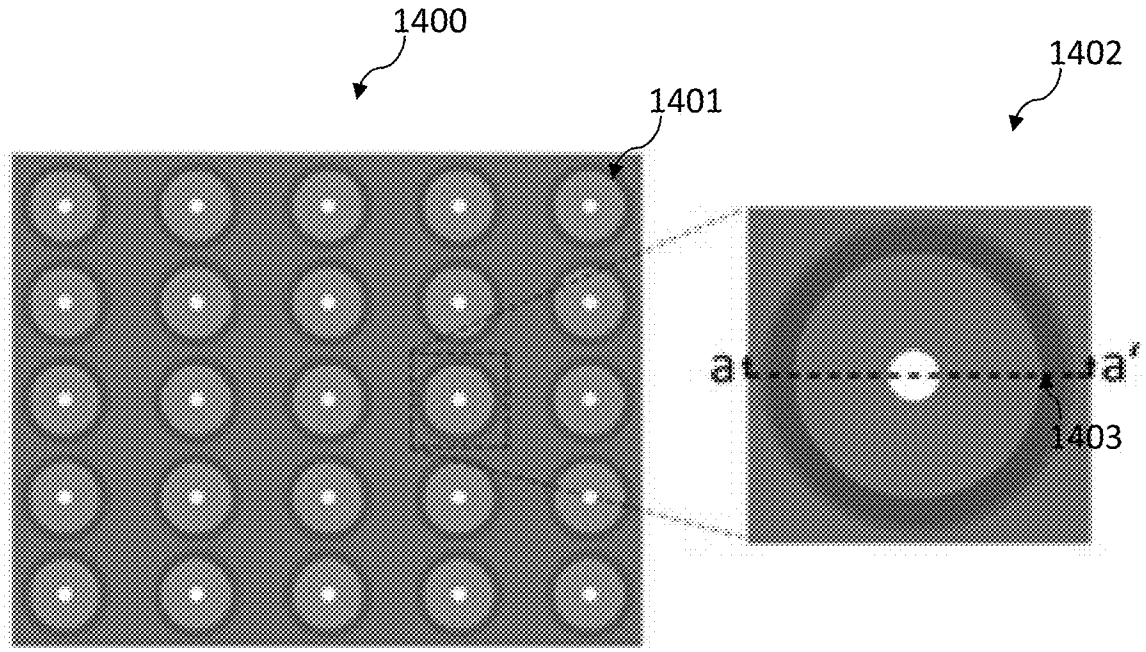
FIG. 14 illustrates another alternative array of graphene membrane transducers of the present invention, which includes a magnified illustrated view of one of the graphene membrane transducers.

FIG. 14 illustrates an array 1400 of alternative graphene membrane transducers 1401, which includes a magnified illustrated view 1402 of one of the graphene membrane transducers 1401. Magnified illustrated view 1402 provides dotted line 1403, which defines a cross section a-a'.

Figure 15:
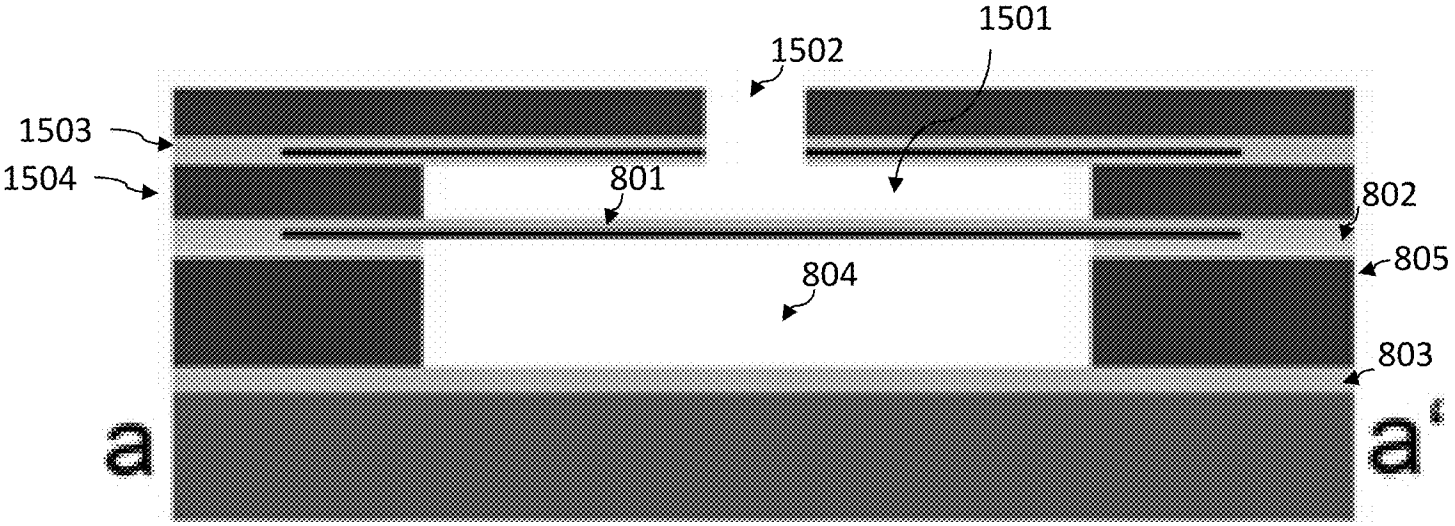
FIG. 15 depicts a cross-sectional (a-a') illustration of the magnified graphene membrane transducer illustrated in FIG. 14.

FIG. 15 depicts the cross-sectional (a-a') illustration of the magnified graphene membrane transducer 1401 illustrated in FIG. 14. Similar to graphene membrane transducer 701 and graphene membrane transducer 1101, graphene membrane transducer 1401 has graphene membrane 801, metallic gate 802, metallic trace 803, cavity 804, and non-conductive member 805. As shown in FIG. 15, graphene membrane transducer 1401 also has a cavity 1501 and a vent hole 1502 through which fluid may flow out of cavity 1501. Furthermore, graphene membrane transducer 1401 also a second metallic trace 1503 with a non-conductive member 1504 (such as oxide) between them.

Figure 16A:
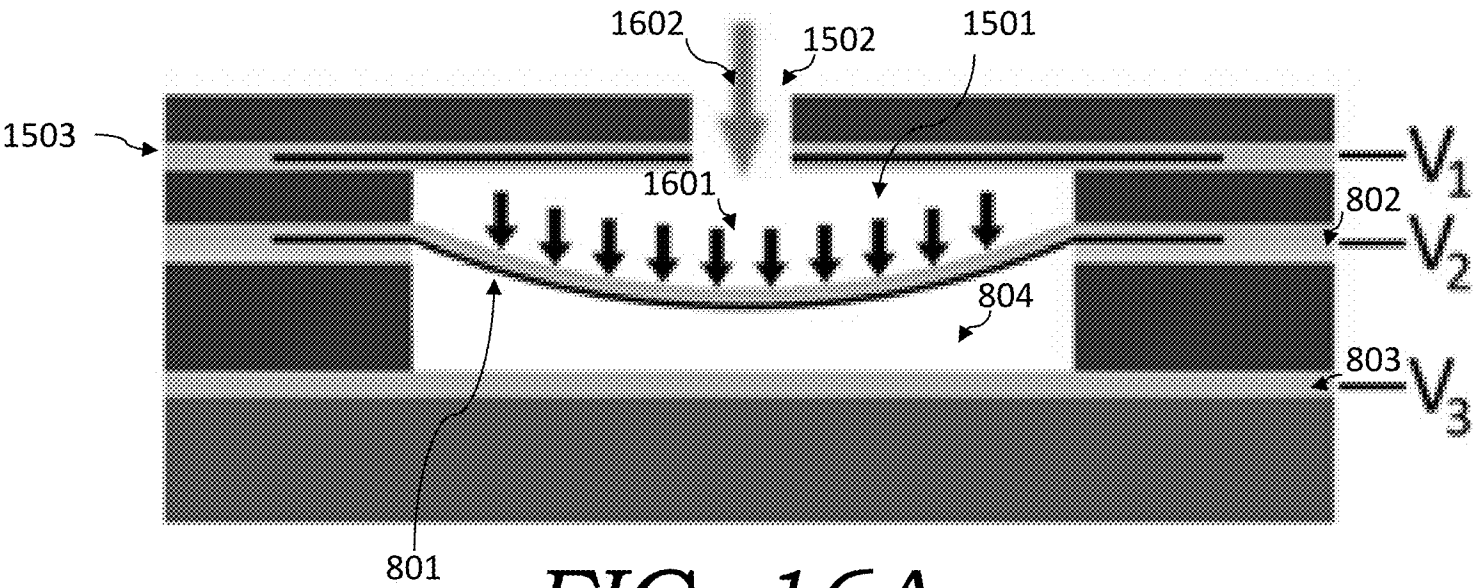
FIGS. 16A-16B depicts an illustration of a graphene membrane transducer (illustrated in FIG. 14) that shows how the graphene membrane moves to cause fluid flow.

FIG. 16A illustrates the graphene membrane transducer 1401 when the graphene membrane 801 is being pulled toward metal trace 803 due to electrostatic forces. In the orientation shown in FIG. 16A, the graphene membrane 801 is being deflected down toward metal trace 803 (as shown by arrows 1601). As with graphene membrane transducer 701, a voltage between the electrically conductive trace 803 and graphene membrane 801 is used to deflect the graphene membrane 801 downward. If $V_2$ is set to ground, this deflection is caused by increasing the voltage at $V_3$. This deflection reduces the volume of cavity 804 (increasing the pressure inside cavity 804) and increases the volume of cavity 1501, thereby causing a fluid to flow into cavity 1501 through vent hole 1502, as shown by arrow 1502.

Figure 16B:
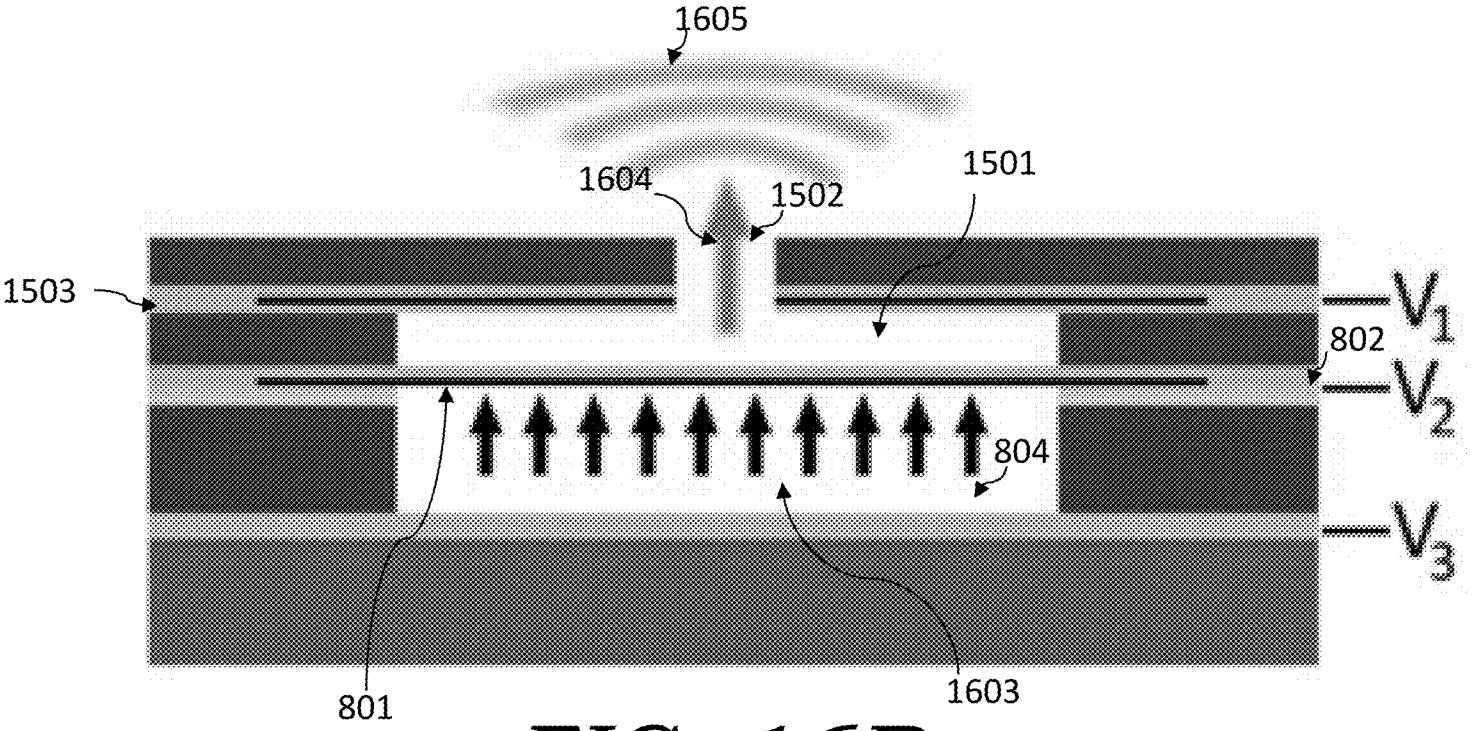

FIG. 16B illustrates the graphene membrane transducer 1401 after the electrostatic forces applied in FIG. 16A are reduced or eliminated and when the graphene membrane 801 deflected back toward the second metallic trace 1503 due to electrostatic forces. When the voltage between the electrically conductive trace 803 and graphene membrane 801 is reduced or eliminated (such as by reducing the voltage at $V_3$) and the voltage between second metallic trace 1503 and graphene membrane 801 is increased (such as by increasing the voltage at $V_1$) the graphene membrane 801 will deflect back toward the second metallic trace 1503 (as shown by arrows 1603). When doing so, the increase in pressure inside cavity 1501 will cause to flow out of cavity 1501 through vent hole 1502, as shown by arrow 1604, which produces waves 1605.

Typically, a gas is maintained in cavity 804, which is sealed. Since the gas in cavity 804 is compressed beneath the graphene membrane 801 as fluid is drawn in the vent hole 1502 (as shown in FIG. 16A), per the orientation of FIGS. 16A-16B, this produces an upward pressure on the graphene membrane 801 that can help push the fluid out of the vent hole 1502 during the exhaust phase shown in FIG. 16B. The mechanical restoration force of the graphene membrane 801 also aids in pushing fluid out the vent hole 1502 along with the electrostatic force between the graphene membrane 801 and the second metallic trace 1503.

Graphene membrane transducer 1401 is also capable of cooling the fluid (such as air) if the graphene membrane 801 is pulled down rapidly (as shown in FIG. 16A) and raised slowly back up toward the vent hole (as shown in FIG. 16B). In this embodiment the graphene membrane transducer could thus be used to create the low density or cool portion of a sound wave or just be used for cooling in general.

Calculations show the ratio of graphene membrane area to vent area should be about ten to about 100 and the mechanical frequency of the graphene membrane should be on the order of 1 MHz for a 25μ diameter graphene drum.

The main operating principle is that air (or other fluid) is drawn in slowly and pushed out quickly (push out time is about three times to about ten times faster than the draw in time). To make a 1 kHz audio signal, an array (thousands to millions) of graphene membrane transducers should cycle about 500 times for each positive portion of the audio wave at on the order of 1 MHz. A cycle includes drawing in air or other fluid and pushing the air or other fluid out over a period of time. For example, a cycle could include drawing in air or other fluid for about 850 ns and pushing the air or other fluid out for about 150 ns over a half a millisecond period to produce the high pressure part of audio wave and then not pumping for another half a millisecond to "produce" the low pressure part of sound wave.

Although the 1 MHz component of the wave is contained within lower frequency audio wave, it cannot be perceived by the human ear. Thus, in some embodiments, the transducer can be an ultrasonic transducer. However, when needed, groups of graphene membrane transducers can be pumped out of phase from each other to cancel the MHz component of the audio wave, thus yielding waves audible to the human ear.

Furthermore, if desired, embodiments of the present invention can be optically transparent and flexible. For example, the primary substrate could be glass in place of silicon and the metal traces could be made of graphene. Mounting speakers on top of display screens may be attractive in some applications (like cell phone, computer and TV screens). The reaction force of the graphene membrane transducers can also be used to levitate and position the graphene membrane transducer array (i.e., the speakers could be directed to position themselves in three dimensions within a room or outdoor arena).

Figure 17:
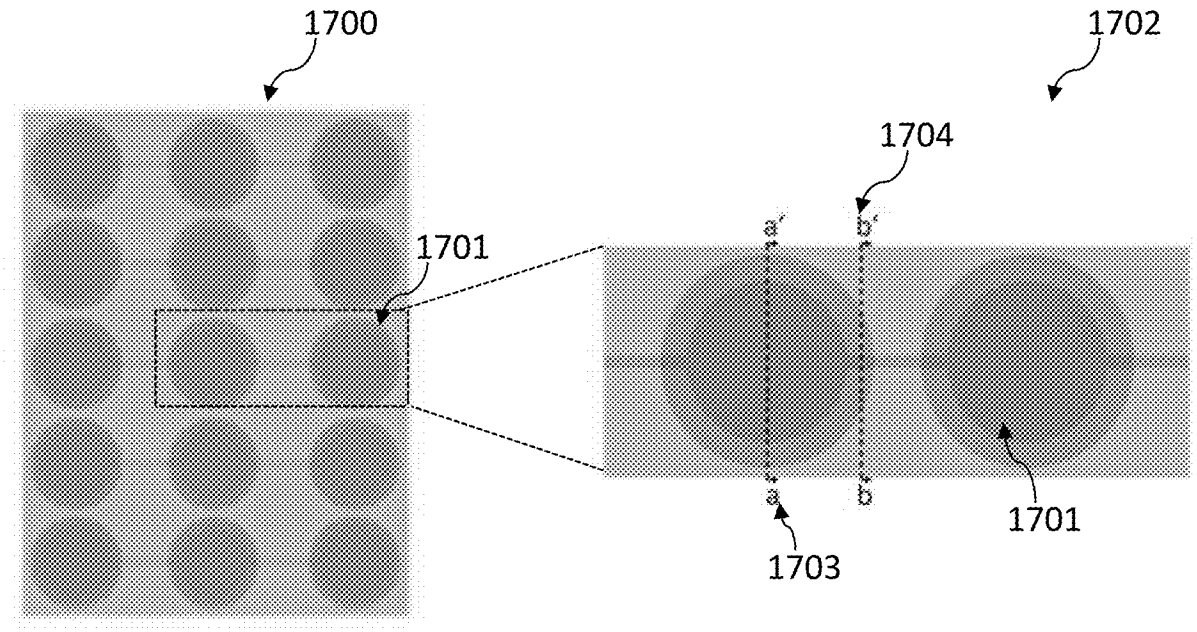
FIG. 17 illustrates another alternative array of graphene membrane transducers of the present invention, which includes a magnified illustrated view of two of the graphene membrane transducers.

FIG. 17 illustrates another alternative array 1700 of graphene membrane transducers of the present invention, which includes a magnified illustrated view of two of the graphene membrane transducers 1701. Magnified illustrated view 1702 provides dotted lines 1703 and 1704, which define a cross section a-a' and b-b', respectively.

Figure 18A:
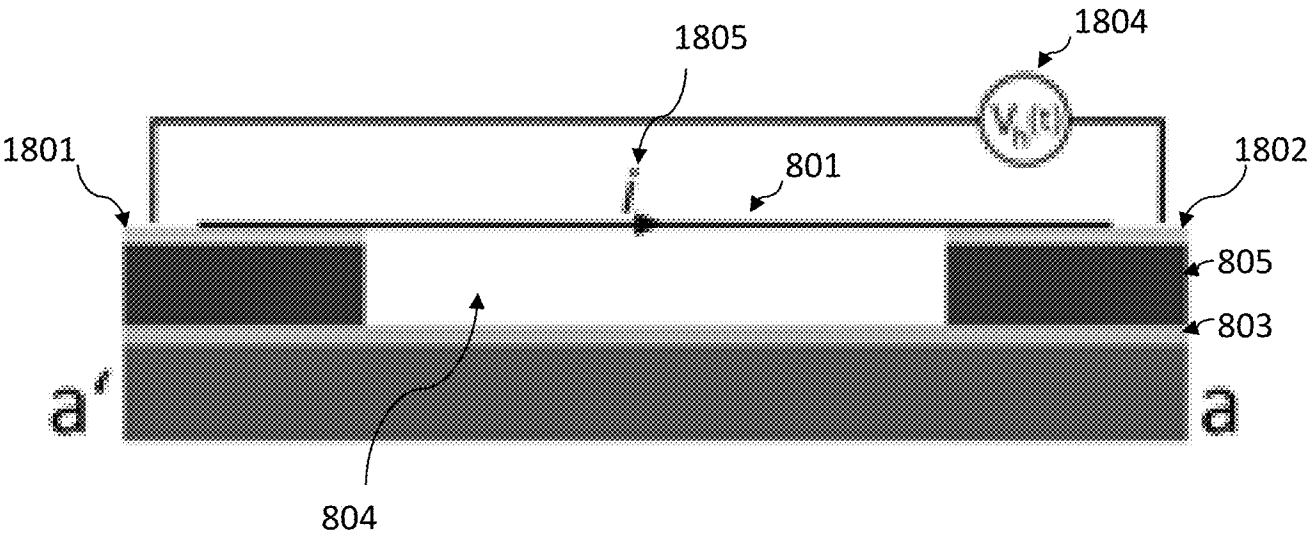
FIG. 18A depicts a cross-sectional (a-a') illustration of the magnified graphene membrane transducer illustrated in FIG. 17.
Figure 18B:
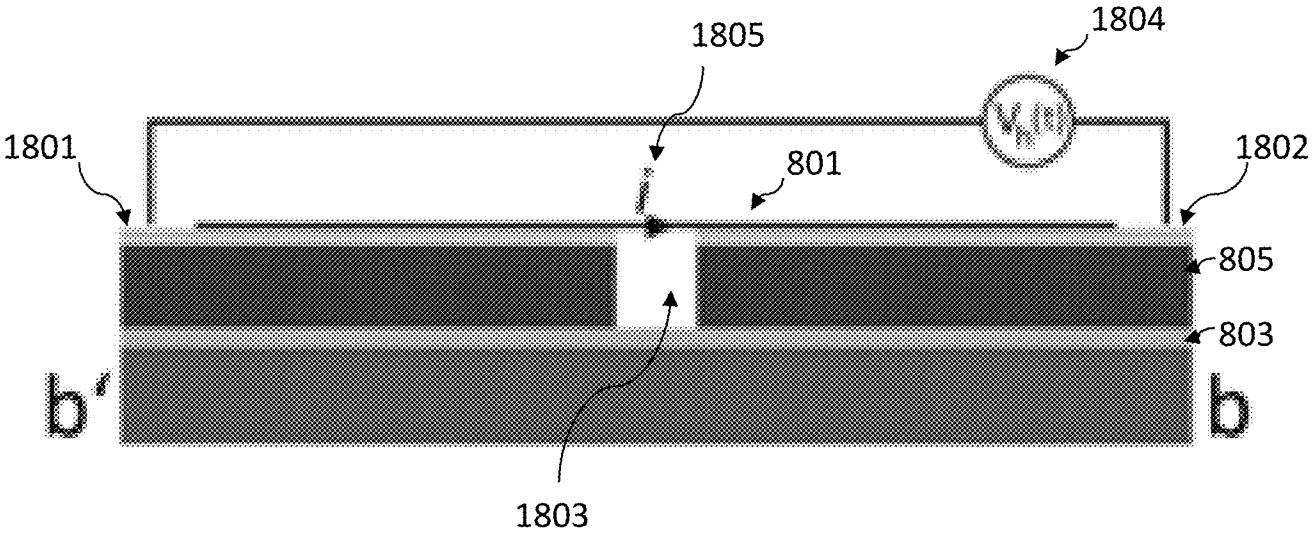
FIG. 18B depicts a cross-sectional (b-b') illustration of the magnified graphene membrane transducer illustrated in FIG. 17.

FIGS. 18A-18B depict cross-sectional illustrations (a-a' and b-b', respectively) of the magnified graphene membrane transducer 1701 illustrated in FIG. 17. Similar to graphene membrane transducer 701, graphene membrane transducer 1101, and graphene membrane transducer 1401, graphene membrane transducer 1701 has graphene membrane 801, metallic trace 803, cavity 804, and non-conductive member 805. In this embodiment, graphene membrane 801 spans two conductive traces (trace 1801 and trace 1802, which can be metallic traces). The space between trace 1801 and trace 1802 forms two vents. One of these vents (vent 1803) is shown in FIG. 18B. The other vent is not shown in FIG. 18B, as it is on the opposing side of graphene membrane transducer 1701.

By placing a voltage 1804 across trace 1801 and trace 1802, current 1805 (generally in the kHz range and in a range closely related to the desired audio signal) can be applied from one trace (trace 1801), through the graphene membrane 801, and into the other trace (trace 1802), which will heat the graphene membrane 801 (via resistance heating). In graphene membrane transducer 1701, the majority of current 1805 will run across the vent 1803 and the other vent because this is the path of least resistance (and where most of the resistive heating will take place).

Figure 19:
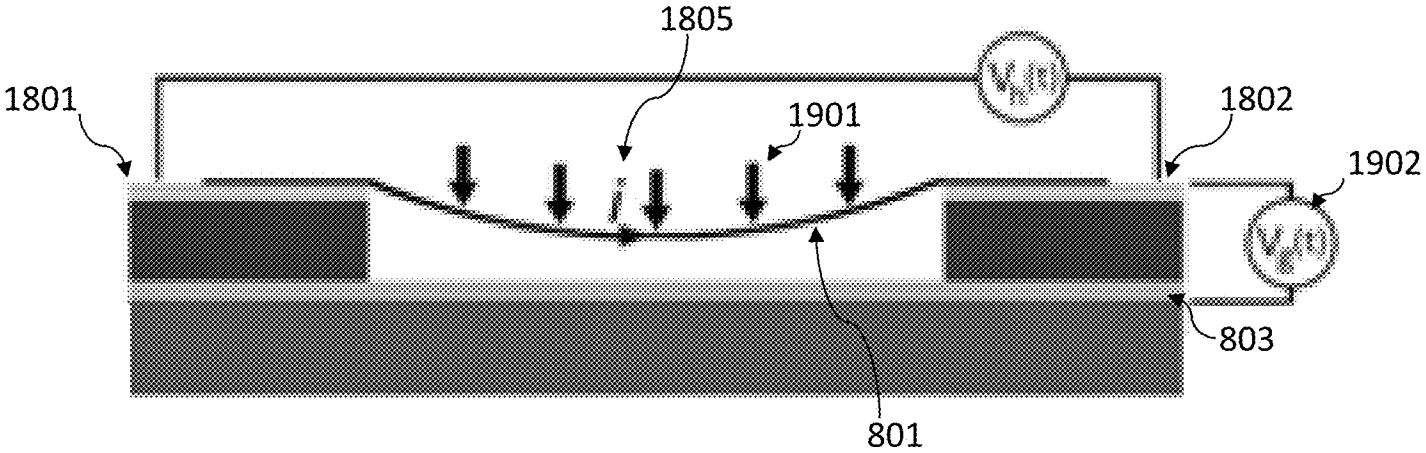
FIG. 19 depicts an illustration of a graphene membrane transducer (illustrated in FIG. 17) that shows how the graphene membrane moves to cause fluid flow.

FIG. 19 illustrates the graphene membrane transducer 1701 when the graphene membrane 801 is being pulled toward metal trace 803 (as shown by arrows 1901) due to electrostatic forces (i.e, by placing a voltage 1902 between graphene 801 and metallic trace 803). Such voltage 1901 can have a frequency in the MHz range, which will make the graphene membrane transducer 1701 pump air in and out of vent 1803 and the other in the order of 100 m/s (which will remove the heat from the graphene membrane 801 and impart it to the surrounding air).

Accordingly, metallic trace 803 can be used to make the graphene membrane 801 oscillate (such as in the MHz range), which will force cooling air across the graphene membrane 801 (and will heats this airflow). Such a system can be used to enhance the transducer mode of the present invention or can be used in a thermo-acoustic mode of the present invention.

Figure 20:
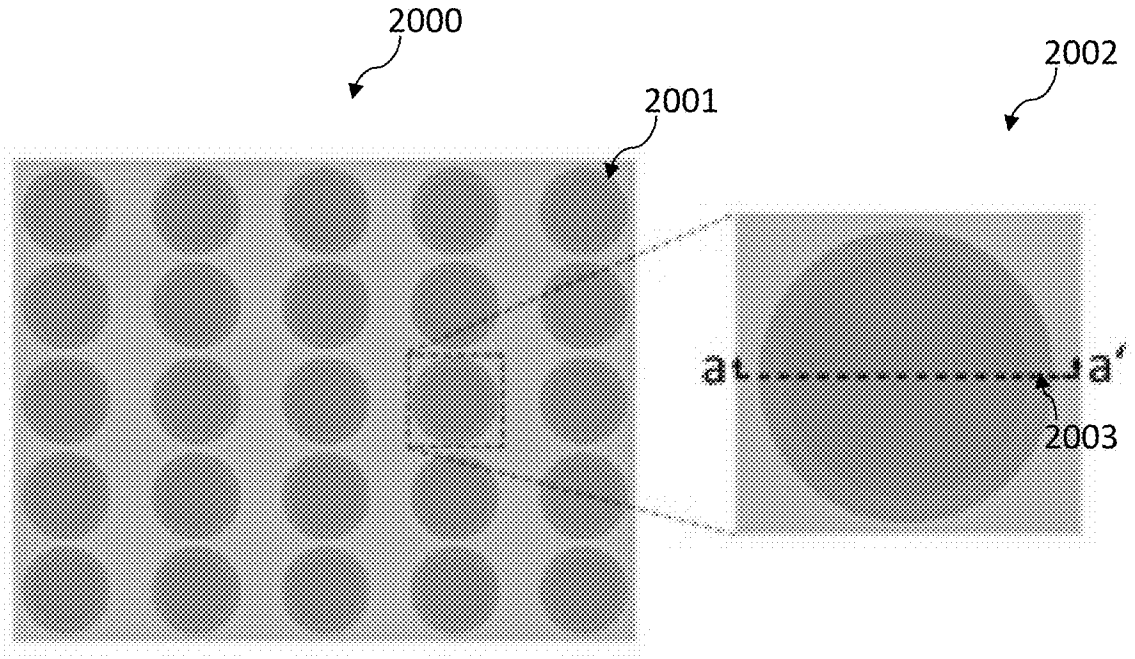
FIG. 20 illustrates another alternative array of graphene membrane transducers of the present invention, which includes a magnified illustrated view of one of the graphene membrane transducers.

FIG. 20 illustrates an array 2000 of another alternative graphene membrane transducers 2001, which includes a magnified illustrated view 2002 of one of the graphene membrane transducers 2001. Magnified illustrated view 2002 provides dotted line 2003, which defines a cross section a-a'.

Figure 21:
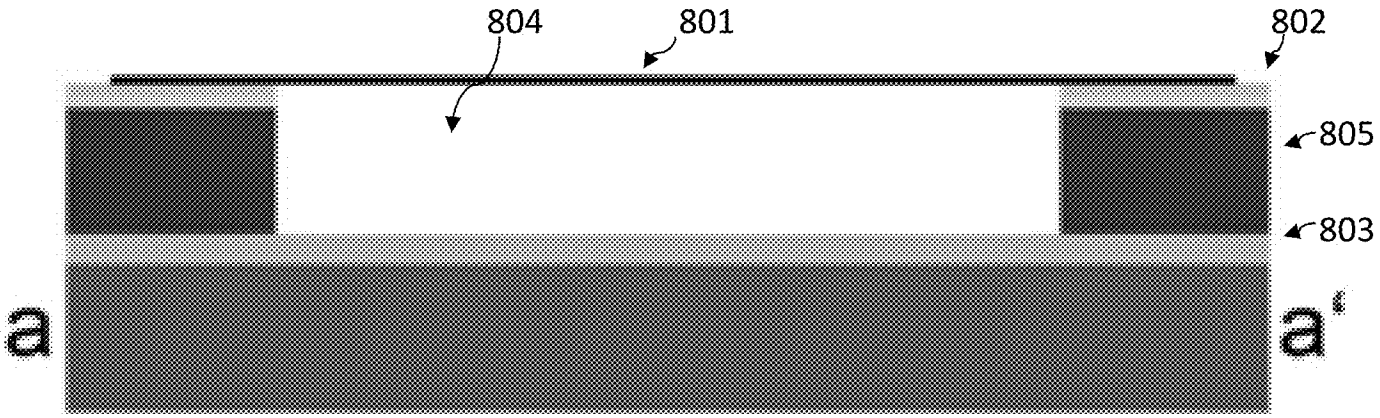
FIG. 21 depicts a cross-sectional (a-a') illustration of the magnified graphene membrane transducer illustrated in FIG. 20.

FIG. 21 depicts the cross-sectional (a-a') illustration of the magnified graphene membrane transducer 2001 illustrated in FIG. 17. Similar to graphene membrane transducer 701, graphene membrane transducer 1101, and graphene membrane transducer 1401, graphene membrane transducer 2001 has graphene membrane 801, metallic gate 802, metallic trace 803, cavity 804, and non-conductive member 805. As shown in FIG. 21, graphene membrane transducer 2001 is similar to graphene membrane 1101 except that it does not have a vent hole 1201.

Figure 22A:
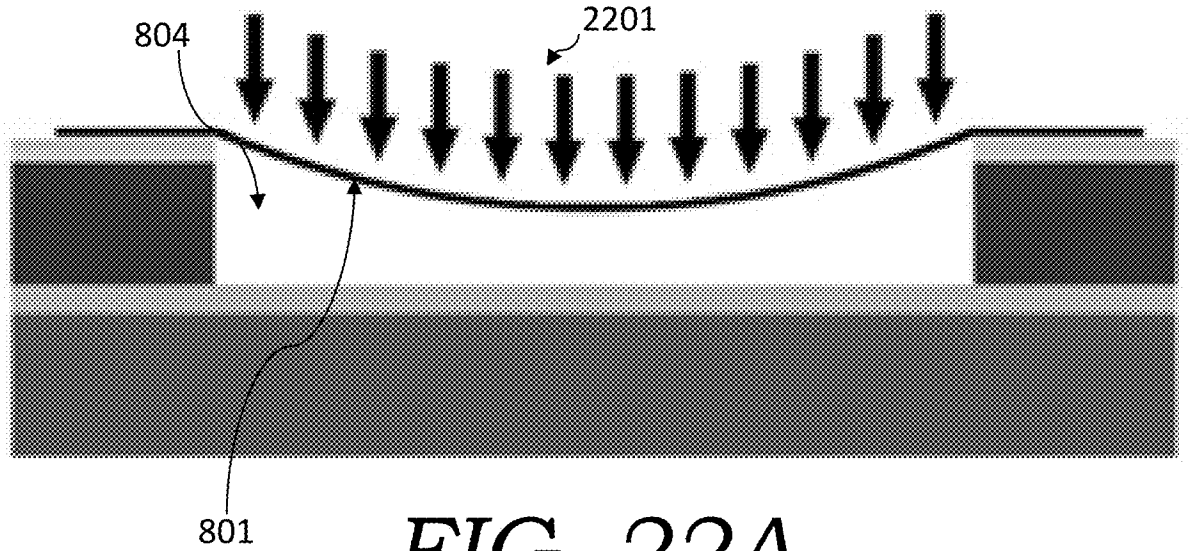
FIGS. 22A-22B depict an illustration of a graphene membrane transducer (illustrated in FIG. 19) that shows how the graphene membrane moves to cause fluid flow.

FIG. 22A illustrates the graphene membrane transducer 2001 when the graphene membrane 801 is being pulled toward metal trace 803 due to electrostatic forces. In the orientation shown in FIG. 22A, the graphene membrane 801 is being deflected down toward metal trace 803 (as shown by arrows 2201). As with graphene membrane transducer 1101, a voltage between the electrically conductive trace 803 and graphene membrane 801 is used to deflect the graphene membrane 801 downward. This deflection reduces the volume of cavity 804, thereby increasing the pressure inside cavity 804, which is sealed and filled with a gas.

Figure 22B:
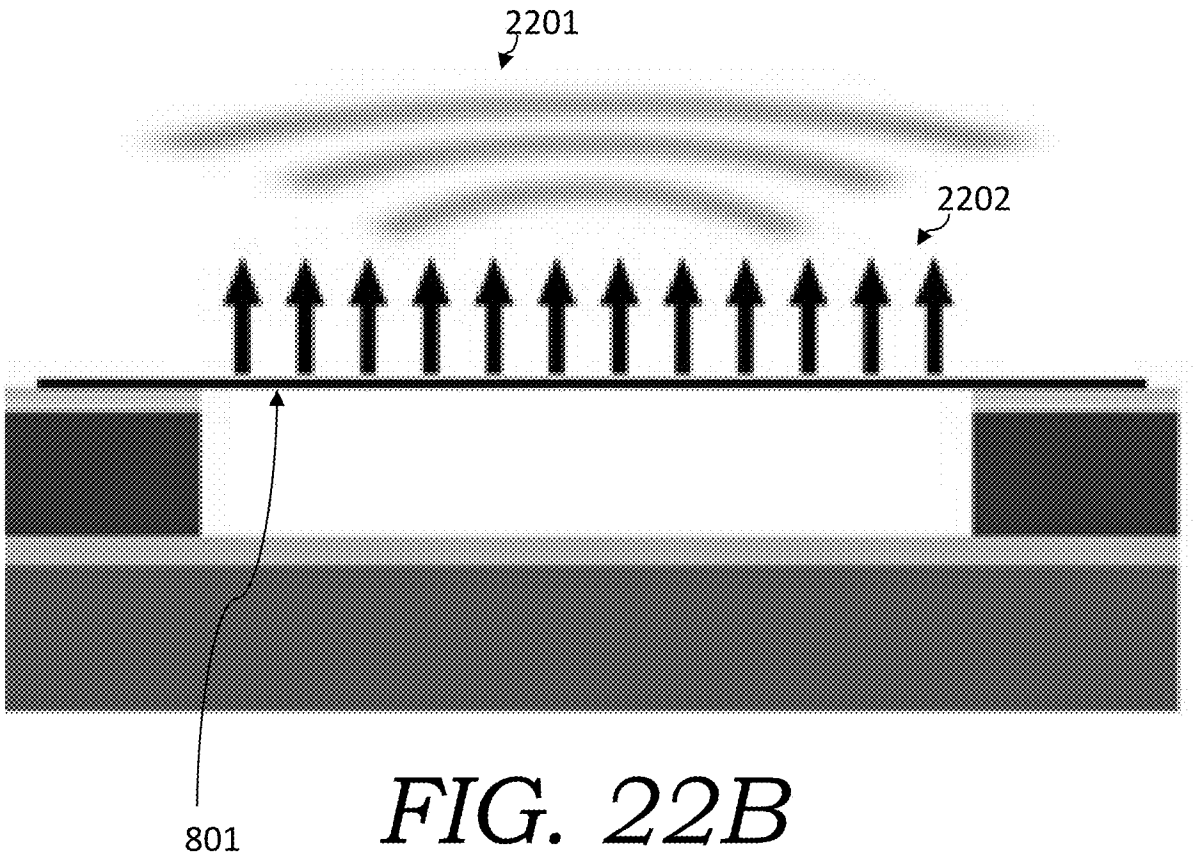

FIG. 22B illustrates the graphene membrane transducer 2001 after the electrostatic forces applied in FIG. 22A are reduced or eliminated. When the voltage between the electrically conductive trace 803 and graphene membrane 801 is reduced or eliminated, the graphene membrane 801 will move back to its original position (as shown by arrows 2202).

As discussed above, a gas is maintained in cavity 804, which is sealed. Since the gas in cavity 804 is compressed beneath the graphene membrane 801 as (as shown in FIG. 22A), per the orientation of FIGS. 22A-22B, this produces an upward pressure on the graphene membrane 801 that can will push the fluid up as during the phase shown in FIG. 22B (as shown by waves 2201).

This system can replace piezoelectric transducers used in conventional liquid ultrasonic applications such as medical imaging. Graphene membrane 801 can be made of several layers of graphene to insure that a water-tight seal is maintained between the graphene and cavity 804.

This system can produces ultrasonic waves at a frequency equal to the mechanical frequency of the graphene membranes.

A significant advantage over prior art ultrasonic transducers is that the present invention has the ability to operate over a wide range of frequencies without losing efficiency. Moreover, the system of the present invention does not need to operate in mechanical resonance, which is often the case with piezoelectric ultrasonic transducers.

Moreover, if some electrically conductive particles are deposited on the electrically conductive trace 803, field emission current between the moveable graphene and these trace particles can be used to sense ultrasonic vibrations in a fluid or gas (i.e., graphene membrane 801 will oscillate in response to pressure changes and these mechanical oscillations will cause a field emission or tunneling currents to oscillate at this same frequency).

FIGS. 23A-23I depict an illustration of a method by which an embodiment of the graphene membrane transducer can be built. It should be noted that FIGS. 23A-23I show how graphene can be used as scaffolding to build up layered devices (containing voids) without using problematic/expensive chemical mechanical polishing. Although the process shown in the figures is used to build a graphene membrane transducer (in this case graphene membrane transducer 1301 as shown in FIG. 14), this process is generally applicable to any MEMS/NEMS device that requires one or more layers with voids.

As illustrated in FIGS. 23A-23I, material 2301 can be silicon or glass, material 2302 is a metal (like tungsten), material 2303 is an electrical insulator (like oxide), the material 2304 is a metal (like gold), and the material 2305 is graphene.

Figure 23A:
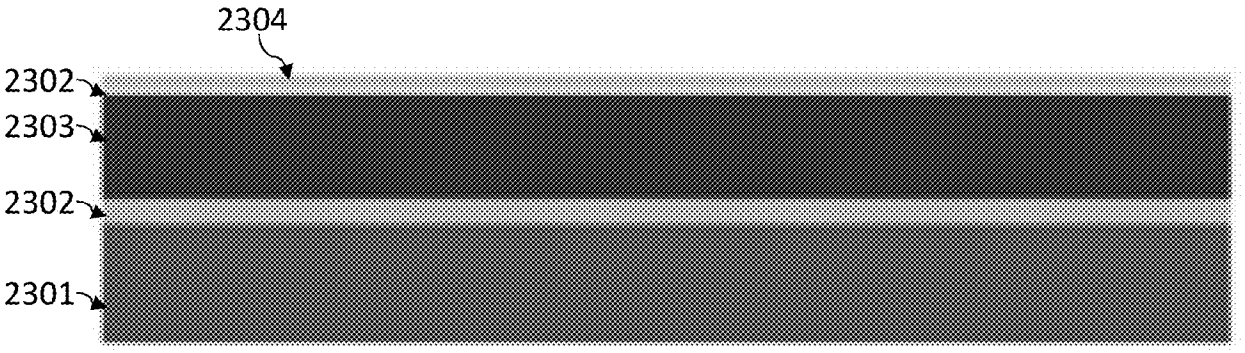
FIGS. 23A-23I depict an illustration of a method by which an embodiment of the graphene membrane transducer can be built.

FIG. 23A illustrates a layered substrate from top to bottom of gold 2304, tungsten 2302, oxide 2303, tungsten 2302, and silicon 2301.

Figure 23B:
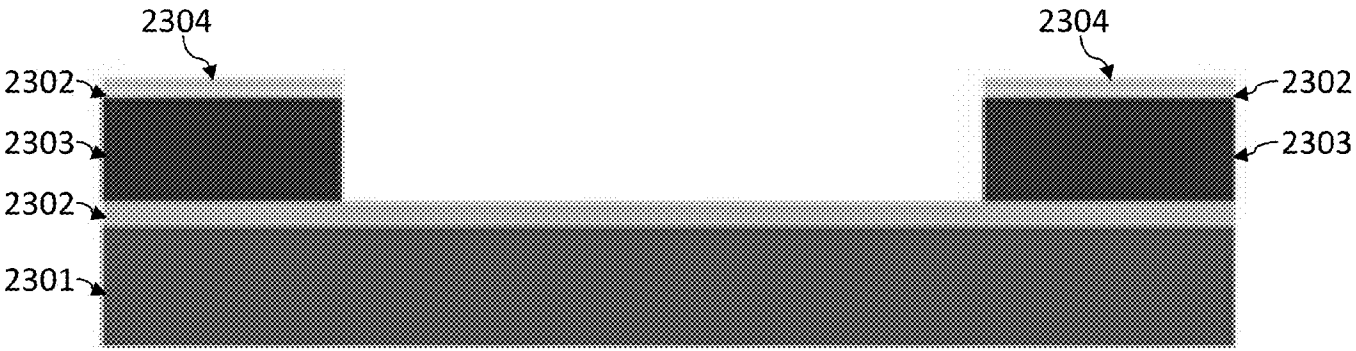

FIG. 23B illustrates a layered substrate in which portions of the top layers of gold 2304, tungsten 2302, oxide 2303 were removed by techniques known in the art. The exposed layer of tungsten that has not been removed is metal trace 803 of graphene membrane transducer 1301. Moreover, the portion of oxide 2303 that remains is non-conductive member 805 of graphene membrane transducer 1301.

Figure 23C:
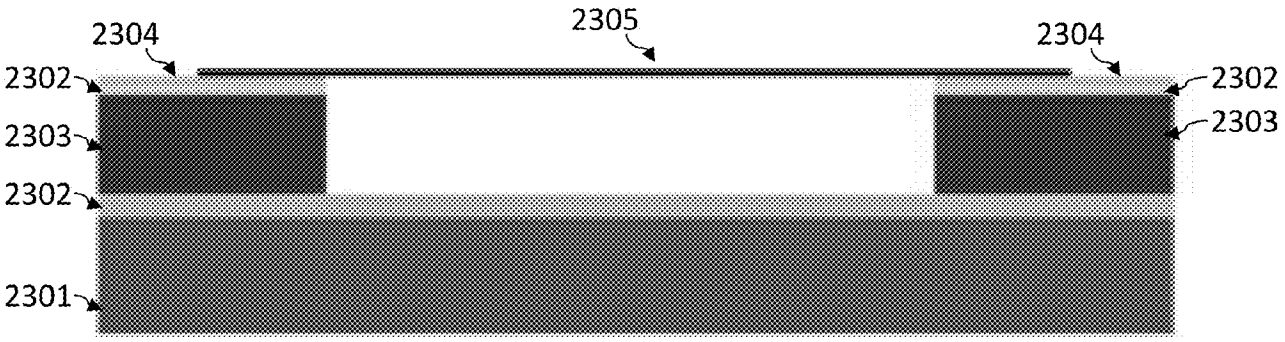

FIG. 23C illustrates the positioning of a graphene membrane 2305 on top of the layered substrate shown in FIG. 23B. Techniques to transfer and position graphene membranes over target features are disclosed and taught in pending and co-owned U.S. patent application Ser. No. 13/098,101 (Lackowski et al.) and 61/427,011 (Everett et al.). This graphene membrane is the graphene membrane 801 of graphene membrane transducer 1301. Moreover, the cavity formed below graphene membrane 2305 in FIG. 23C is cavity 804 of graphene membrane transducer 1301.

Figure 23D:
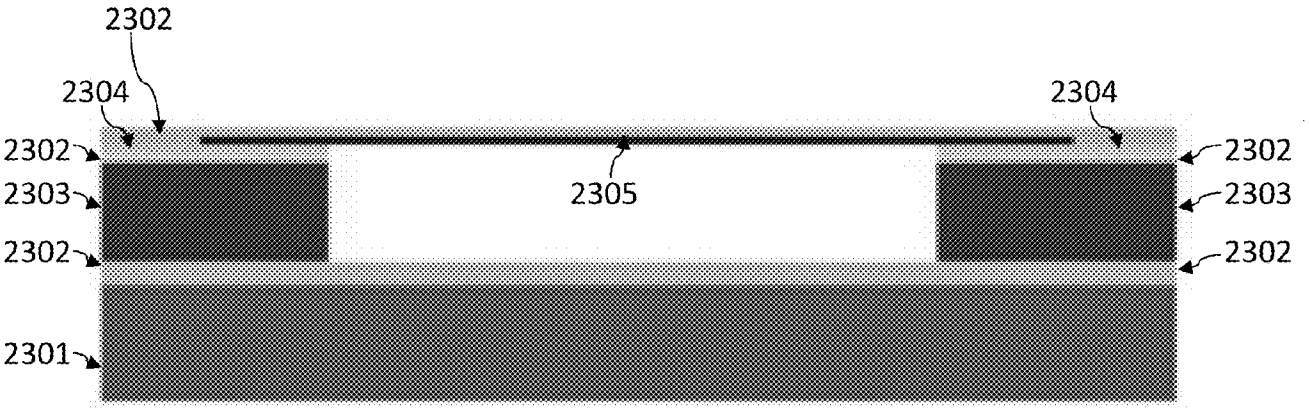

FIG. 23D illustrates depositing tungsten 2302 on top of graphene membrane 2305 using techniques known in the art. The combination of the tungsten 2305 and gold 2304 about the graphene membrane is the metallic gate 802 of graphene membrane transducer 1301.

Figure 23E:
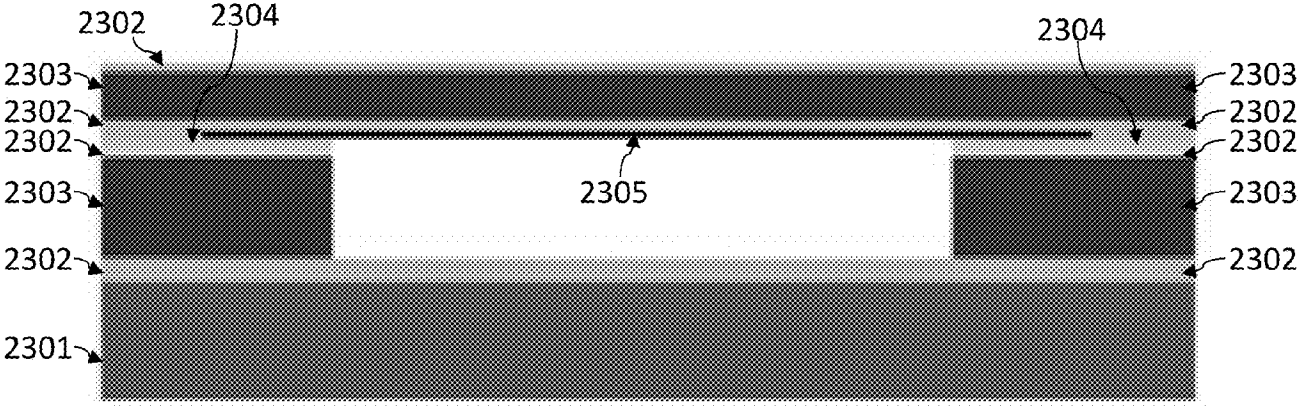

FIG. 23E illustrates depositing oxide 2303 and then depositing tungsten 2302 on top of the oxide 2303 using techniques known in the art.

Figure 23F:
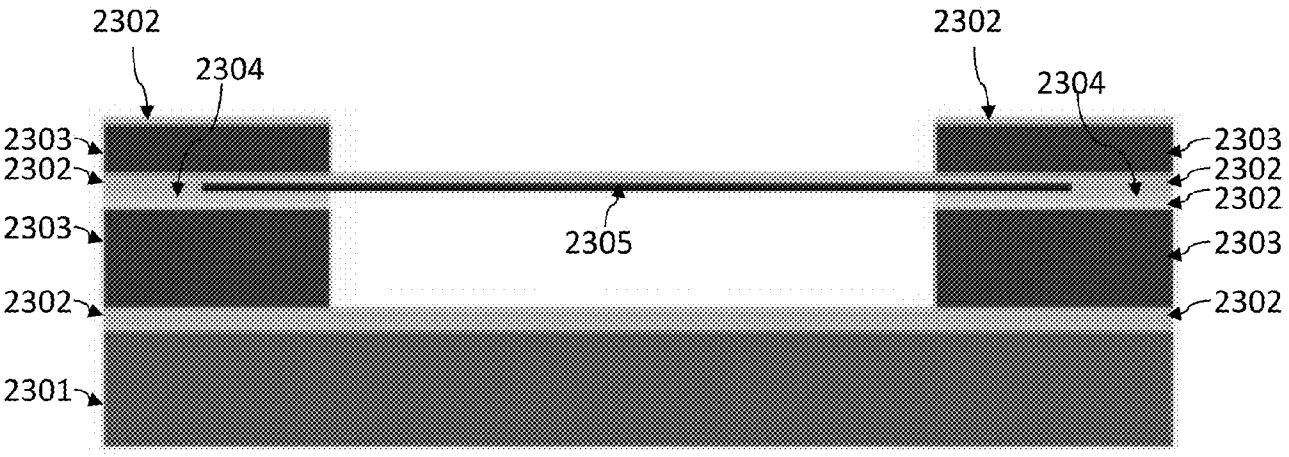

FIG. 23F illustrates the layered substrate in which portions of the top layers of tungsten 2302 and oxide 2303 were removed by techniques known in the art. The portion of oxide 2303 that remains is non-conductive member 1404 of graphene membrane transducer 1301.

Figure 23G:
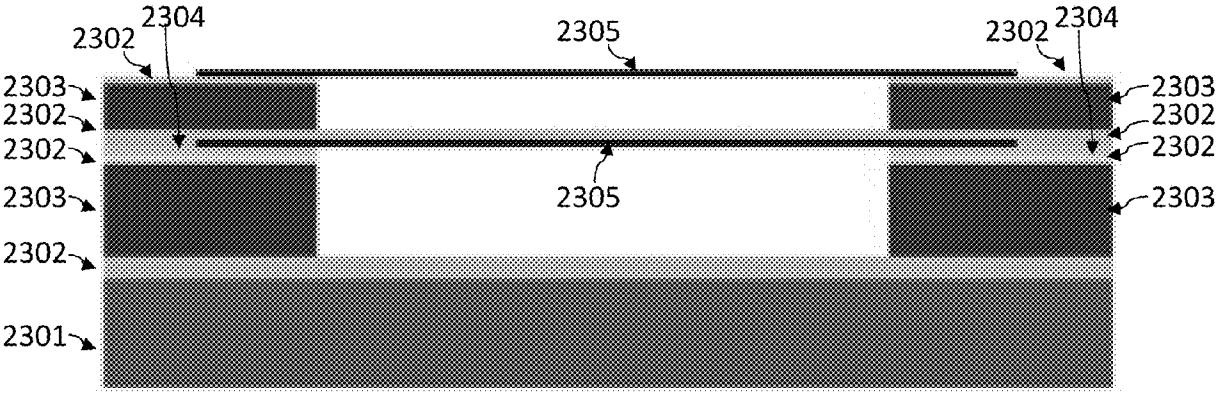

FIG. 23G illustrates the positioning of a graphene membrane 2305 on top of the layered substrate shown in FIG. 23F using techniques known in the art. The cavity formed below graphene membrane 2305 in FIG. 23G is cavity 1401 of graphene membrane transducer 1301.

Figure 23H:
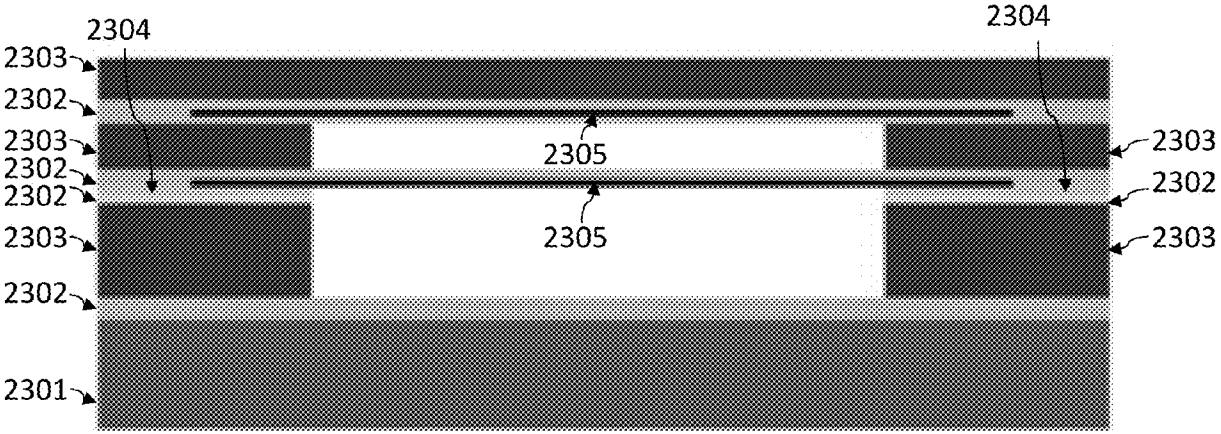

FIG. 23H illustrates depositing tungsten 2302 and then depositing oxide 2303 on top of the graphene membrane 2305 using techniques known in the art.

Figure 23I:
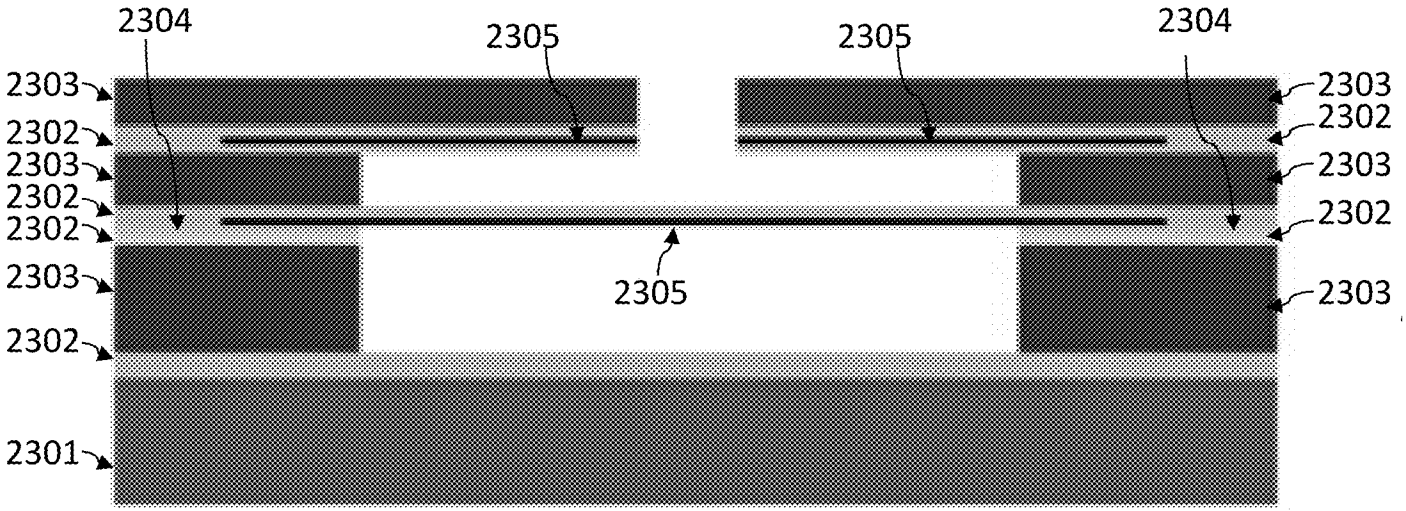

FIG. 23I illustrates the layered substrate in which portions of the top layers of oxide 2303, tungsten 2302, and graphene membrane 2305 were removed by techniques known in the art to form a hole. This hole is vent hole 1402 of graphene membrane transducer 1301. The portion of tungsten 2302 and graphene membrane 2305 that remains is the second metallic trace 1403 of graphene membrane transducer 1301.

Because graphene is just a few angstroms thick and adheres closely to almost any material, it does not cause significant ripples in the materials deposited on top of it (and thus does not require CMP between layers). Even though it is thin, graphene is strong enough to hold up the weight of materials many times its own weight. Once a thin layer of material like metal is deposited (and solidifies) on top of graphene, this new material can help support subsequent layers of material.

Figure 24:
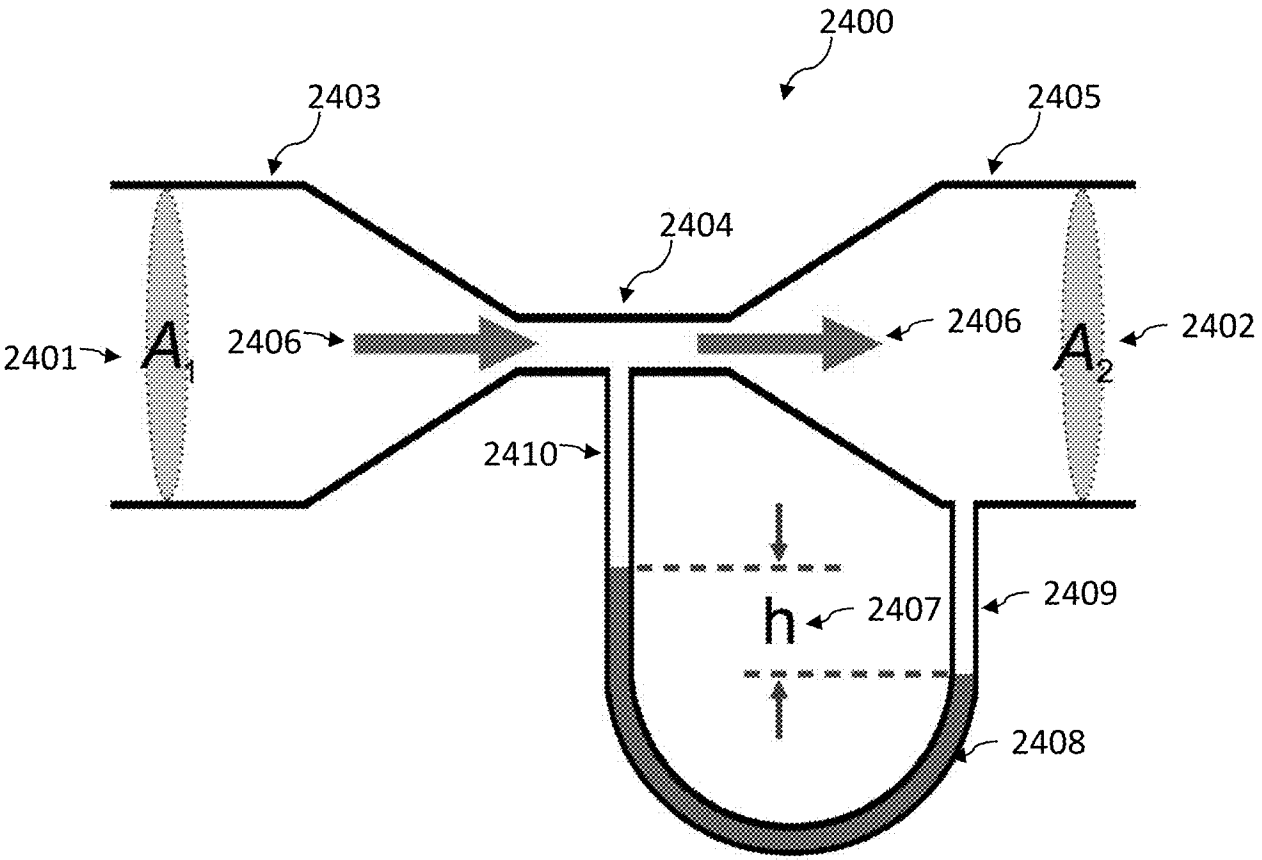
FIG. 24 depicts a system showing a venturi effect.

FIG. 24 depicts a system 2400 showing a venturi effect. This system 2400 has an inlet orifice 2403 (having a cross-sectional area ($A_1$) 2401), an outlet orifice 2405 (having a cross-sectional area ($A_2$) 2402), and a venturi channel 2404. The venturi channel 2404 is a constriction (i.e., the cross-sectional area of the venturi channel 2404 is less than cross-sectional area ($A_1$) 2401 and cross-sectional area ($A_2$) 2402, such that the velocity 2406 of the fluid flow through venturi channel 2404 is much higher, as compared with the velocity 2406 in the inlet orifice 2403 and outlet orifice 2405). The venturi channel 2404 also includes a venturi orifice 2410 that is exposed to a partial vacuum in the venturi channel 2404. The partial vacuum is illustrated in FIG. 24 by the change in height 2407 of the fluid 2408 in the venturi orifice 2410 and the connection 2409 to the outlet orifice 2405.

Figure 25A:
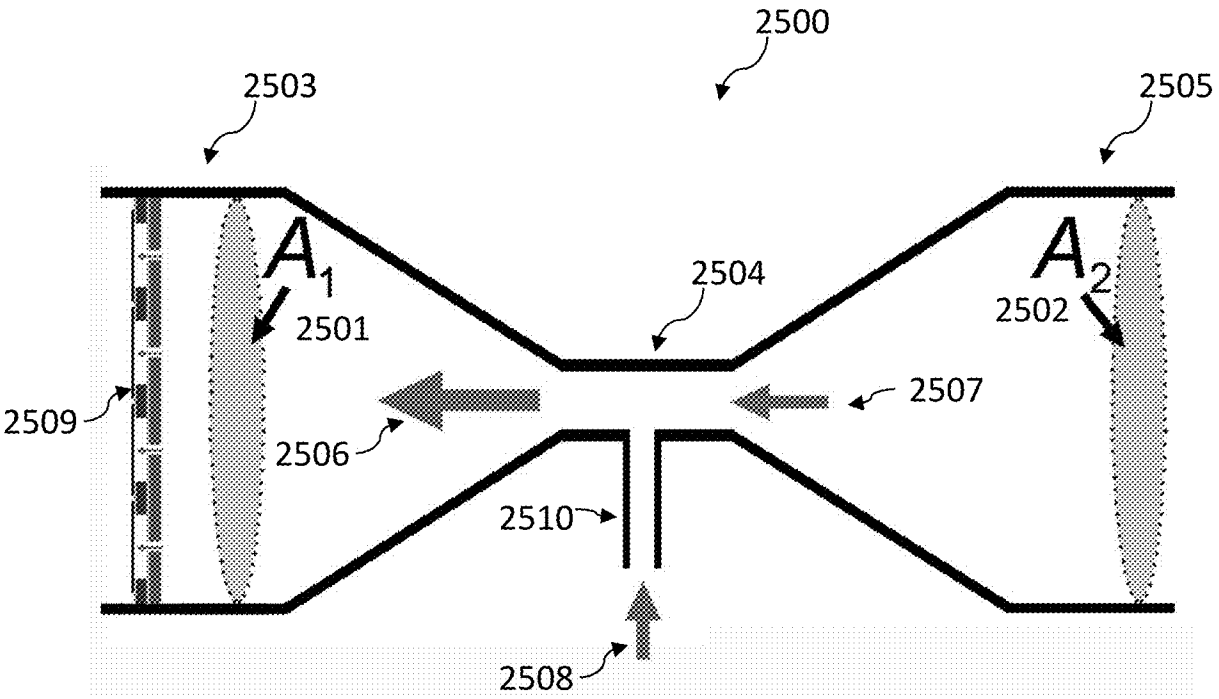
FIGS. 25A-25B depict illustrations of a graphene membrane pump/transducer that utilizes a venturi channel and that shows how the graphene membranes move to cause fluid flow.
Figure 25B:
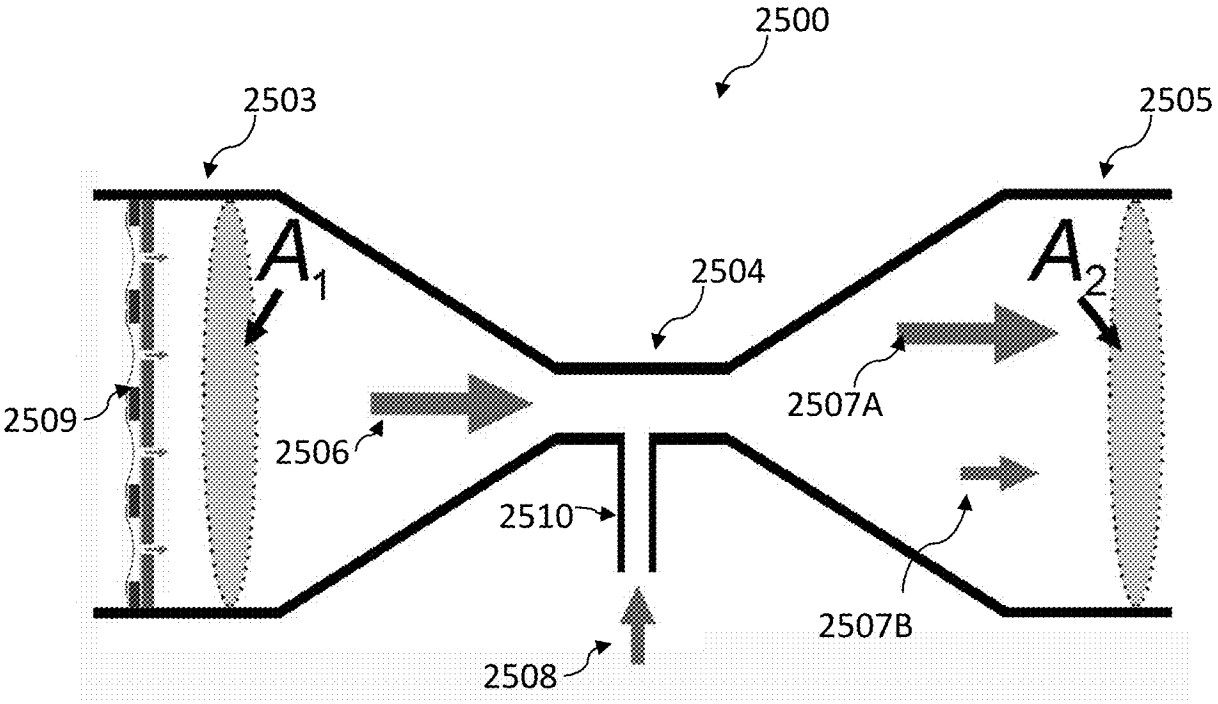

FIGS. 25A-25B depict illustrations of a graphene membrane pump/transducer 2500 that utilizes a venturi channel 2504 and that show how graphene membranes 2509 move to cause fluid flow. FIG. 25A illustrates the graphene membrane pump/transducer 2500 in the inflow process. Graphene membrane pump/transducer 2500 has an array of graphene membranes 2509 deflecting away from the substrate (i.e., to the left in the orientation of FIG. 25A) and thus pulling a fluid (such as air) into pump orifice 2503 (having cross-sectional area ($A_1$) 2501) via the venturi channel 2504. This high velocity of fluid in the venturi channel 2504 (which can be, in some embodiments approximately 10-100 meters/second for airflow) creates a partial vacuum within the venturi channel 2504 and as a result some fluid (such as air) is drawn into the venturi channel 2504 via the venturi orifice 2510. The fluid flow in the pump orifice 2503, the outlet orifice 2505, and the venturi orifice 2510 are represented, respectively, by arrows 2506, 2507, and 2508. The inflow of fluid (such as air) that passes through the pump orifice 2503 (having cross-sectional area ($A_1$) 2501) is the sum of the air flowing in from the outlet orifice 2505 and the air drawn into the venturi orifice 2510. Thus, the fluid flowing across cross-sectional area ($A_1$) 2503 is greater than the fluid flowing across cross-sectional area ($A_2$) 2505.

FIG. 25B illustrates the graphene membrane pump/transducer 2500 in the outflow process. When the graphene membranes 2509 move toward the substrate (i.e., to the right in the orientation of FIG. 25B) the direction of the fluid flow in the pump orifice 2503, the outlet orifice 2505, and the venturi channel 2504 reverses but the high velocity fluid moving through the venturi channel 2504 still creates a partial vacuum, which draws fluid into the venturi orifice 2510. The fluid flow in the pump orifice 2503 and the venturi orifice 2510 are represented, respectively, by arrows 2506 and 2508. The fluid flow in the outlet orifice 2505 is represented by arrows 2507A and 2507B. In the embodiment shown in FIG. 25B, the volume of fluid flowing through the pump orifice 2503 is less than the volume of gas flowing through the outlet orifice 2505.

Even though the air flowing through the pump orifice 2503 is on average zero (since the average inflow is equal to the average outflow), there is a net airflow that is exhausted through the outlet orifice 2505 due to the addition of the air flowing into the venturi orifice 2510.

This net airflow through the outlet orifice 2505 can be used to produce an audible sound wave (20 Hz to 20 kHz) even though the graphene membranes may have a mechanical frequency in the ultrasonic range (above 20 kHz). The average airflow exhausted through the outlet orifice 2505 can also be used to cool electronic components, produce thrust, or pump a fluid. Although an array of graphene membranes is shown in FIGS. 25A-25B, the graphene membrane pump/transducer 2500 would also operate with a single graphene membrane.

While embodiments of the invention have been shown and described, modifications thereof can be made by one skilled in the art without departing from the spirit and teachings of the invention. The embodiments described and the examples provided herein are exemplary only, and are not intended to be limiting. Many variations and modifications of the invention disclosed herein are possible and are within the scope of the invention. Accordingly, other embodiments are within the scope of the following claims. The scope of protection is not limited by the description set out above, but is only limited by the claims which follow, that scope including all equivalents of the subject matter of the claims.

The disclosures of all patents, patent applications, and publications cited herein are hereby incorporated herein by reference in their entirety, to the extent that they provide exemplary, procedural, or other details supplementary to those set forth herein.

What is claimed is:

1. A pump comprising:

(a) one or more electrically conductive membranes;

(b) a cavity bounded at least in part by a substrate, wherein the cavity has a volume that changes due to the movement of the one or more electrically conductive membranes;

(c) a venturi channel operatively connected to the cavity, wherein the venturi channel is operatively connected to a venturi orifice;

(d) an outlet orifice operatively connected to the venturi channel;

(e) an electrically conductive trace located near and apart from the one or more electrically conductive membranes; and (f) a time varying voltage between the one or more electrically conductive membranes and the electrically conductive trace, wherein (i) the time varying voltage is operable for moving the one or more electrically conductive membranes in a first direction and a second direction relative to the substrate, (ii) the combined movement of the one or more electrically conductive membranes in a first and second direction is operable to cause a fluid to enter the venturi orifice and exit the outlet orifice, and (iii) the pump is a valve-less pump that operates at a frequency above 20 kHz.

2. The pump of claim 1, wherein the one or more electrically conductive membranes are each less than 100 nm thick.

3. The pump of claim 1, wherein the one or more electrically conductive membranes comprise graphene.

4. The pump of claim 1, wherein the electrically conductive trace comprises metal.

5. The pump of claim 1, wherein the electrically conductive trace comprises silicon.

6. The pump of claim of 1, wherein (a) the time varying voltage is operable for moving the one or more electrically conductive membranes in a first direction and a second direction relative to the substrate during a plurality of cycle periods;

(b) each of the cycle periods comprises a first portion wherein the voltage is applied, and (c) each of cycle periods comprises a second portion wherein the voltage is reduced or terminated.

7. The pump of claim 6, wherein, in each of the cycle periods, the second portion of the cycle period is longer than the first portion of the cycle period.

8. The pump of claim 6, wherein, in each of the cycle periods, the second portion of the cycle period is shorter than the first portion of the cycle period.

9. The pump of claim 1, wherein the fluid is air.

10. An audio speaker comprising:

(a) one or more electrically conductive membranes;

(b) a cavity bounded at least in part by a substrate, wherein the cavity has a volume that changes due to the movement of the one or more electrically conductive membranes;

(c) a venturi channel operatively connected to the cavity, wherein the venturi channel is operatively connected to a venturi orifice;

(d) an outlet orifice operatively connected to the venturi channel;

(e) an electrically conductive trace located near and apart from the one or more electrically conductive membranes; and (f) a time varying voltage between the one or more electrically conductive membranes and the electrically conductive trace, wherein (i) the time varying voltage has an ultrasonic frequency, (ii) the time varying voltage is operable for moving the one or more electrically conductive membranes in a first direction and a second direction relative to the substrate, (iii) the combined movement of the one or more electrically conductive membranes in a first and second direction is operable to cause air to enter the venturi orifice and exit the outlet orifice at an average flow rate, and (iv) the average airflow rate is varied between 20 Hz and 20 kHz to produce an audible sound, and (v) the audio speaker is a valve-less audio speaker.

11. The audio speaker of claim 10, wherein the one or more electrically conductive membranes each are less than 100 nm thick.

12. The audio speaker of claim 10, wherein the one or more electrically conductive membranes comprise graphene.

13. The audio speaker of claim 10, wherein the electrically conductive trace comprises metal.

14. The audio speaker of claim 10, wherein the electrically conductive trace comprises silicon.

15. The audio speaker of claim of 10, wherein (a) the time varying voltage is operable for moving the electrically conductive membrane in a first direction and a second direction relative to the substrate during a plurality of cycle periods;

(b) each of the cycle periods comprises a first portion wherein the voltage is applied, and (c) each of cycle periods comprises a second portion wherein the voltage is reduced or terminated.

16. The audio speaker of claim 15, wherein, in each of the cycle periods, the second portion of the cycle period is longer than the first portion of the cycle period.

17. The audio speaker of claim 15, wherein, in each of the cycle periods, the second portion of the cycle period is shorter than the first portion of the cycle period.

18. The audio speaker of claim 15, wherein each of the cycle periods takes between around 0.01 microsecond and around 10 microseconds.

19. The audio speaker of claim 10, wherein the audio signal is around a 1 kHz audio wave.

20. The audio speaker of claim 10 further comprising a second metallic trace, wherein (a) the second electrically conductive trace is positioned such that (i) when the electrically conductive membrane is moving toward the electrically conductive trace, the electrically conductive membrane is moving away from the second electrically conductive trace, and (ii) when the electrically conductive membrane is moving away from the electrically conductive trace, the electrically conductive membrane is moving toward the second electrically conductive trace, and (b) the electrically conductive membrane is operable to move toward the second electrically conductive trace when a second voltage is applied between the electrically conductive membrane and the second electrically conductive trace.

* * * * *